US006758020B2

(12) United States Patent
Cerrato

(10) Patent No.: US 6,758,020 B2
(45) Date of Patent: Jul. 6, 2004

(54) FLEXIBLE INTERLOCKING WALL SYSTEM

(75) Inventor: Dominic Cerrato, Wintersville, OH (US)

(73) Assignee: Cercorp Initiatives Incorporated, Steubenville, OH (US)

( * ) Notice: Subject to any disclaimer, the term of this patent is extended or adjusted under 35 U.S.C. 154(b) by 0 days.

(21) Appl. No.: 09/877,914

(22) Filed: Jun. 8, 2001

(65) Prior Publication Data

US 2002/0043038 A1 Apr. 18, 2002

Related U.S. Application Data

(63) Continuation-in-part of application No. 09/290,635, filed on Apr. 12, 1997, now Pat. No. 6,244,009, which is a continuation-in-part of application No. 08/925,311, filed on Sep. 8, 1997, now Pat. No. 5,899,040.

(51) Int. Cl.[7] ..... E04B 5/04

(52) U.S. Cl. ..... 52/606; 52/223.7; 52/590.3; 52/592.5; 52/592.6

(58) Field of Search ..... 52/592.6, 604, 52/605, 607, 223.7, 293.2, 295, 439, 589.1, 590.2, 592.1, 405.3, 590.3, 592.4, 592.5, 606

(56) References Cited

U.S. PATENT DOCUMENTS

| | | | | |
|---|---|---|---|---|
| 2,610,503 A | * | 9/1952 | Hall | |
| 2,655,032 A | * | 10/1953 | Zagray | |
| 2,902,853 A | * | 9/1959 | Lofstrom | |
| 5,566,517 A | * | 10/1966 | Ishii et al. | 52/387 |
| 3,534,518 A | * | 10/1970 | Zagray | |
| 3,618,279 A | * | 11/1971 | Sease | |
| 3,668,832 A | | 6/1972 | Harman | |
| 3,791,090 A | | 2/1974 | Kniefel | |
| 4,031,678 A | * | 6/1977 | Schuring | 52/285 |
| 4,367,615 A | | 1/1983 | Feldman | |
| 4,726,567 A | | 2/1988 | Greenberg et al. | |
| 5,007,218 A | | 4/1991 | Bengtson et al. | |
| 5,138,808 A | | 8/1992 | Bengtson et al. | |
| 5,282,700 A | | 2/1994 | Rodrique | |
| 5,685,119 A | * | 11/1997 | Zschoppe | 52/592.5 |
| 5,715,635 A | * | 2/1998 | Sherwood | 52/285 |
| 5,899,040 A | * | 5/1999 | Cerrato | 52/604 |
| 5,966,889 A | * | 10/1999 | Zinner | 52/606 |
| 5,987,840 A | * | 11/1999 | Leppert | 52/592.6 |
| 6,098,357 A | * | 8/2000 | Franklin et al. | 52/223.7 |
| 6,105,330 A | * | 8/2000 | Nanayakkara | 52/606 |
| 6,161,357 A | * | 12/2000 | Altemus | 52/592.6 |
| 6,244,009 B1 | * | 6/2001 | Cerrato | 52/604 |

FOREIGN PATENT DOCUMENTS

| | | |
|---|---|---|
| DE | 197 00 345 A1 | 7/1998 |
| EP | 0 701 033 A1 | 7/1995 |

* cited by examiner

*Primary Examiner*—Carl D. Friedman
*Assistant Examiner*—Yvonne M. Horton
(74) *Attorney, Agent, or Firm*—Robert G. Lev

(57) ABSTRACT

A masonry wall system is disclosed incorporating a plurality of courses of masonry blocks, each block has vertical and horizontal interlocking structures with mating surfaces (11, 15, 16, 17). The main block, has a stabilizing slot. Metal reinforcement tendons are inserted into these stabilizing holes (14) at predetermined intervals and connected to the wall at the top and bottom. Corner blocks (26) are employed to connect the walls at right angles and are used in alternating configurations to staggered the vertical joints from course to course. This is also done with the main blocks. The predetermined tolerances between the masonry components and the reenforcing tendons permit the wall to have a fluid property. Forces such as settling, hydrostatic pressure and seismic disturbances are then automatically absorbed and systematically distributed across the entire wall. When all of the masonry components reach the end of their tolerance, the wall locks up as a solid interconnected mass. The force is then passed on to the stabilizing tendons which now act to stabilize the wall against further movement. The movement of the wall can be adjusted after assembly of this wall by applying increased tension to the tendons.

45 Claims, 29 Drawing Sheets

FIG. 3
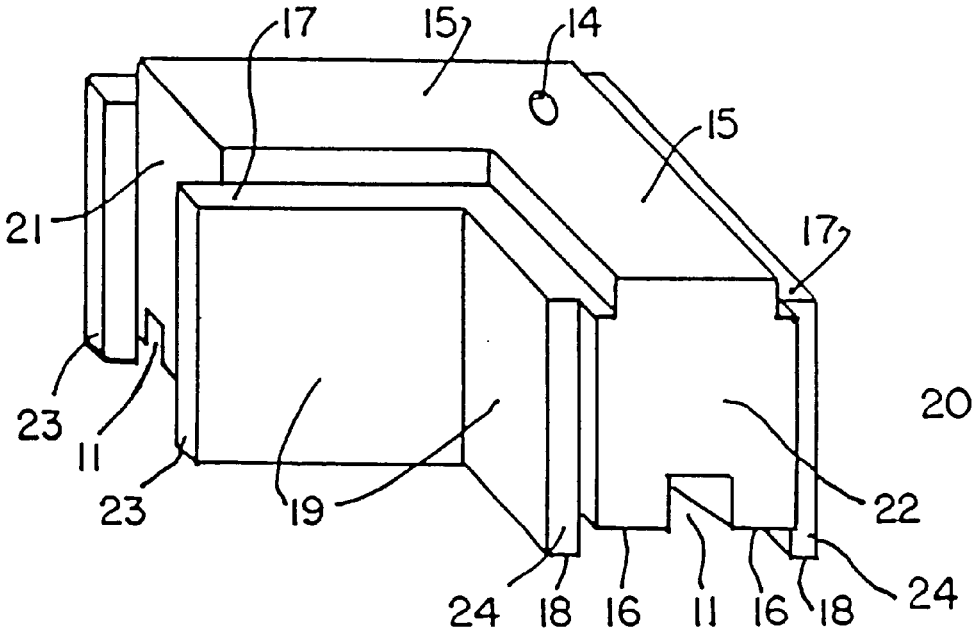
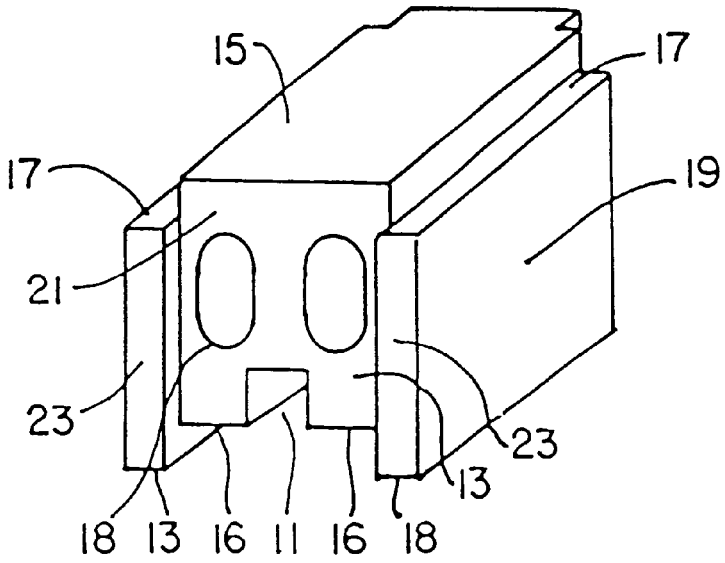
FIG. 4

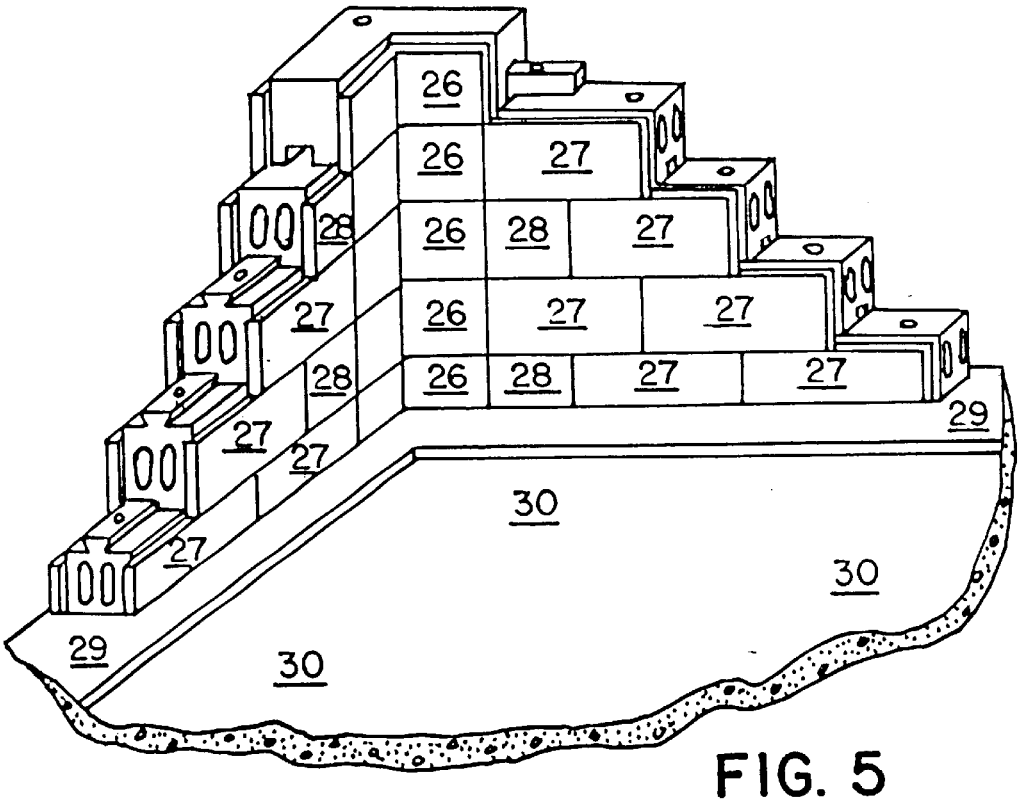
FIG. 5
FIG. 6
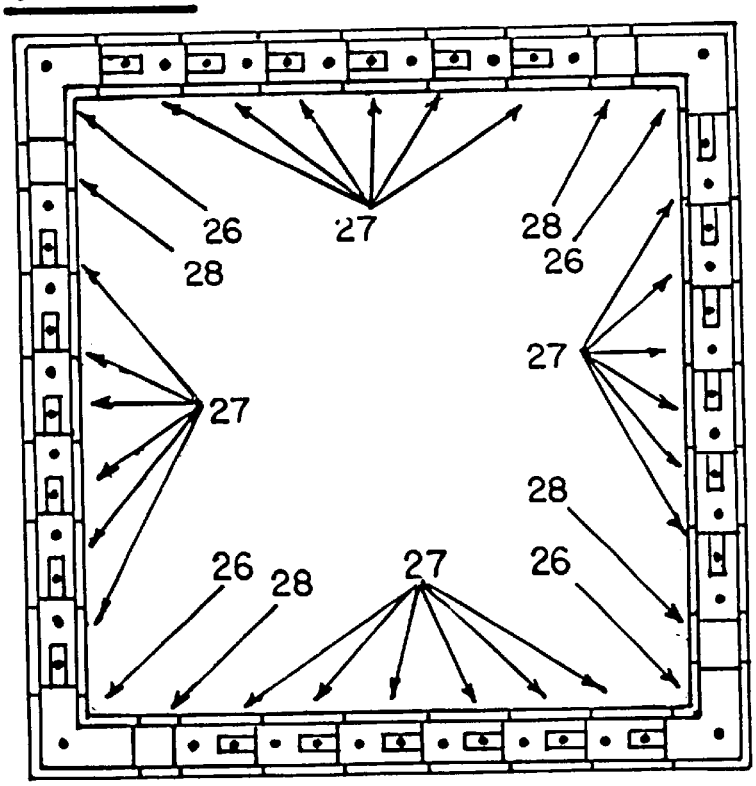

FIG. 12A
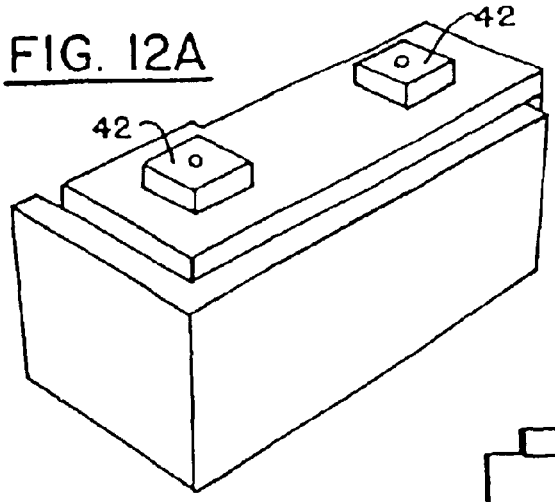
FIG. 12B
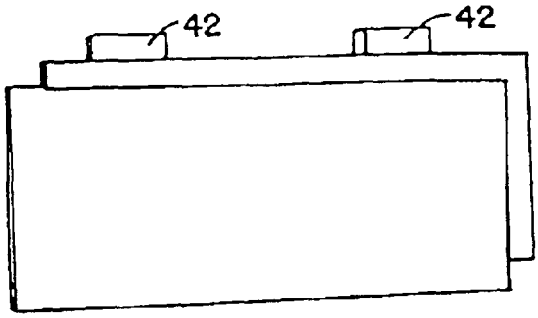
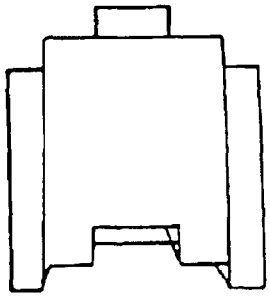
FIG. 12C
FIG. 12D
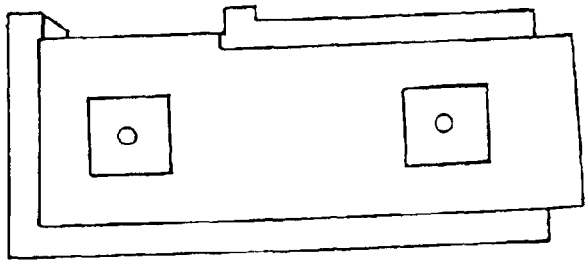
FIG. 12E
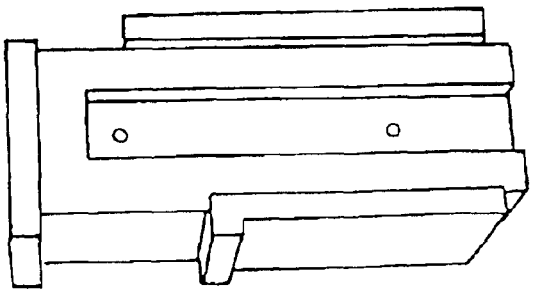

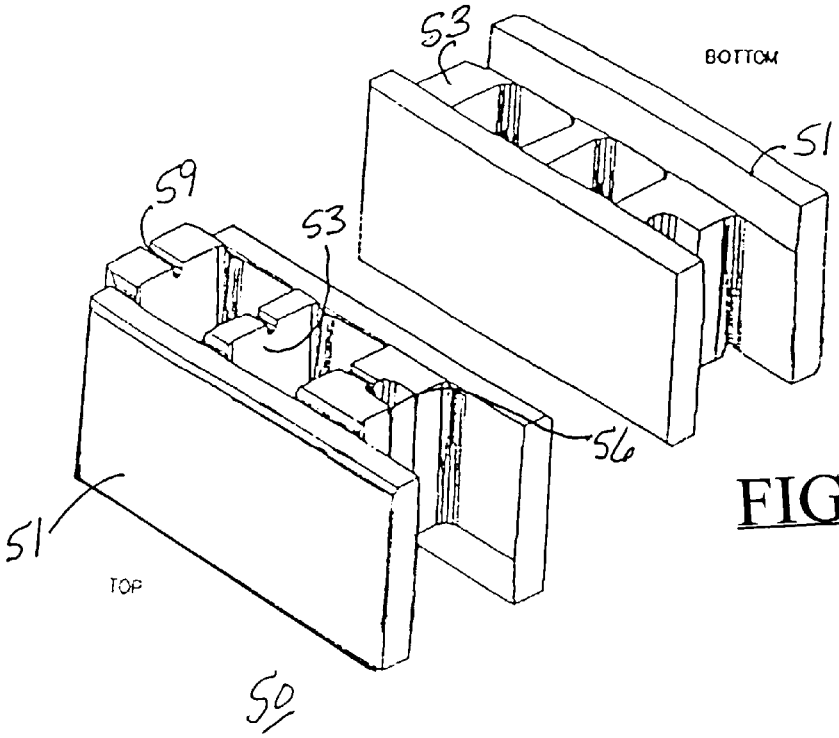
FIG. 19A
FIG. 19B
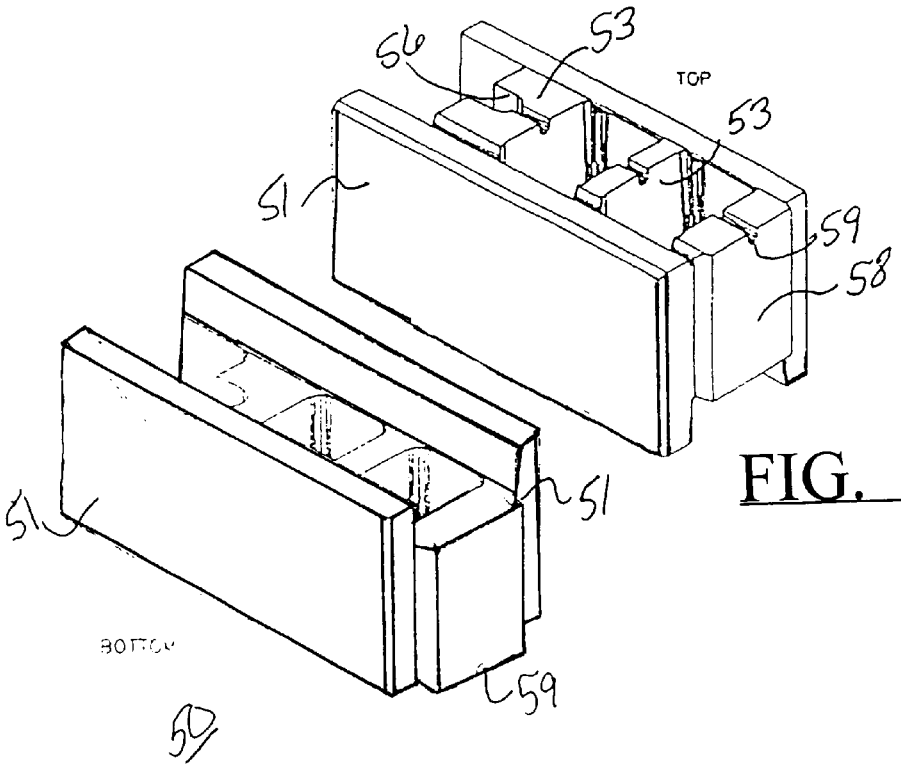
FIG. 19C
FIG. 19D

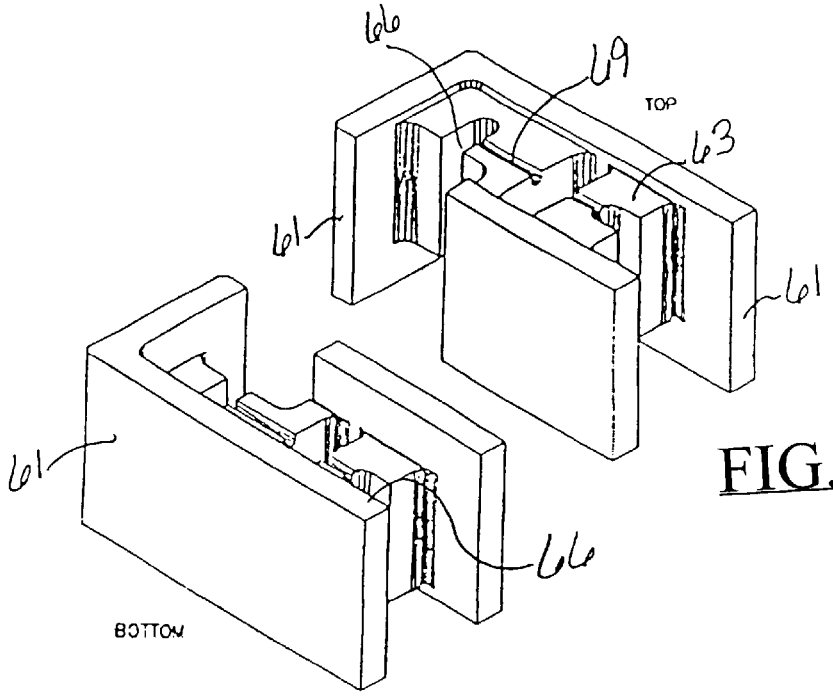
FIG. 20A
FIG. 20B
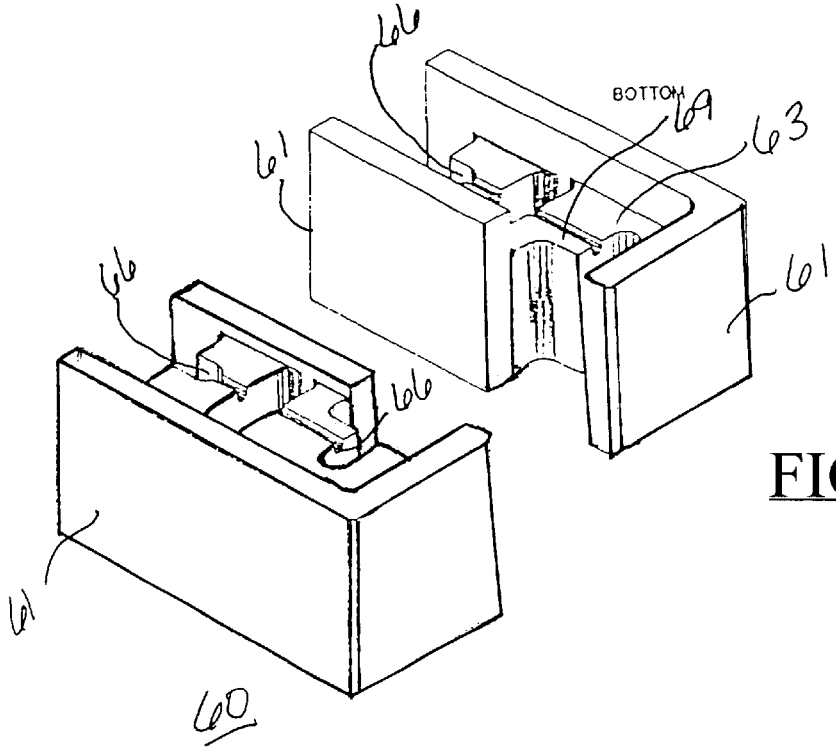
FIG. 20C
FIG. 20D

FIG. 23A
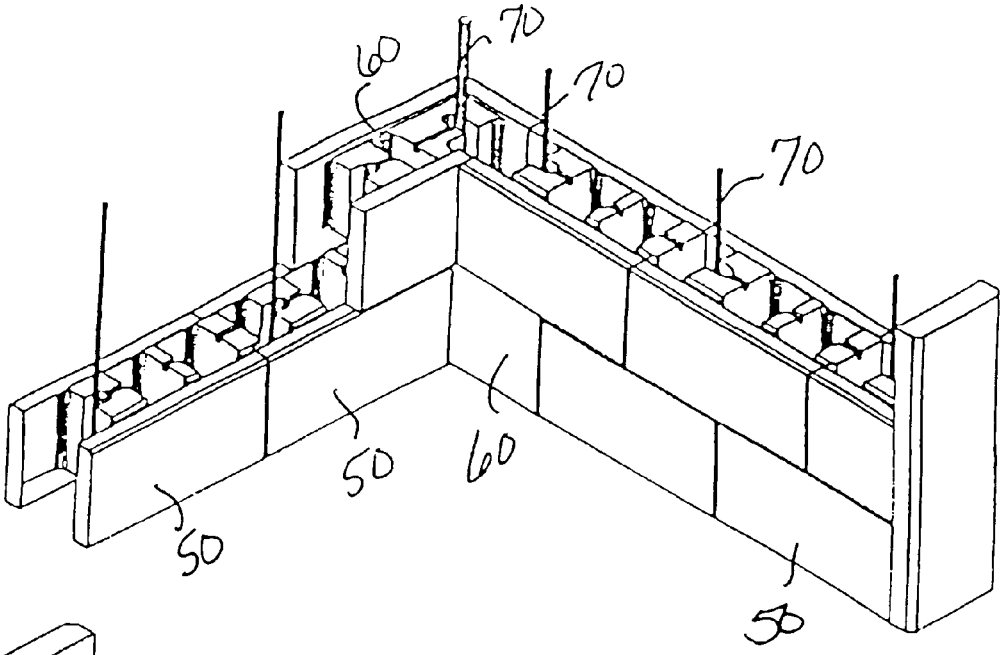
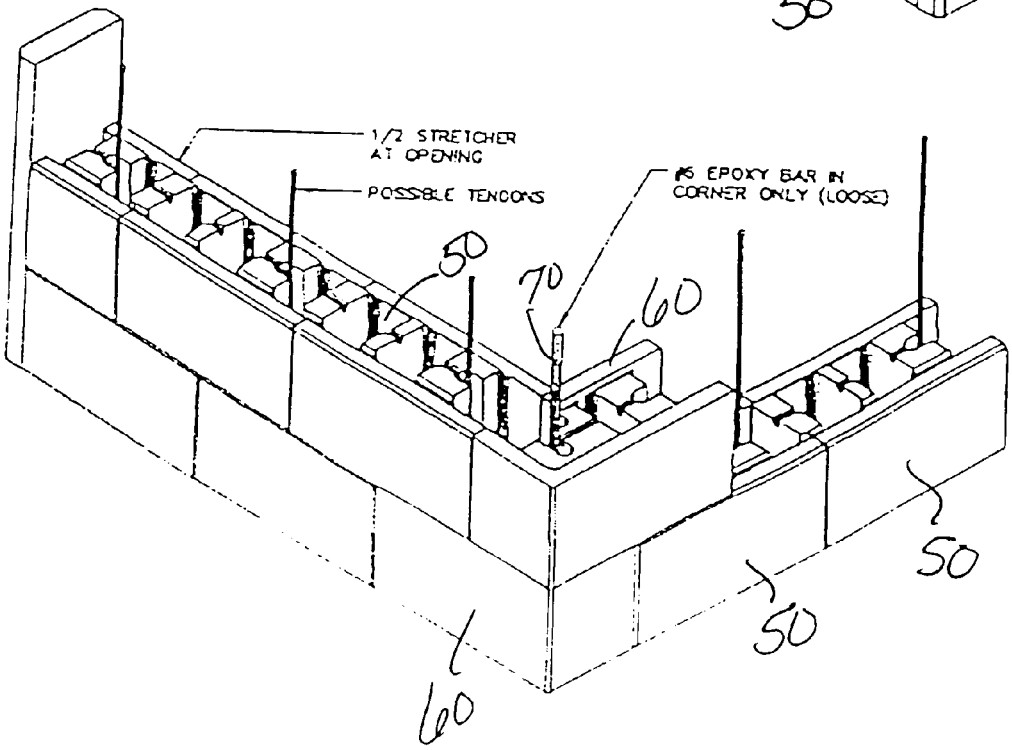
FIG. 23B

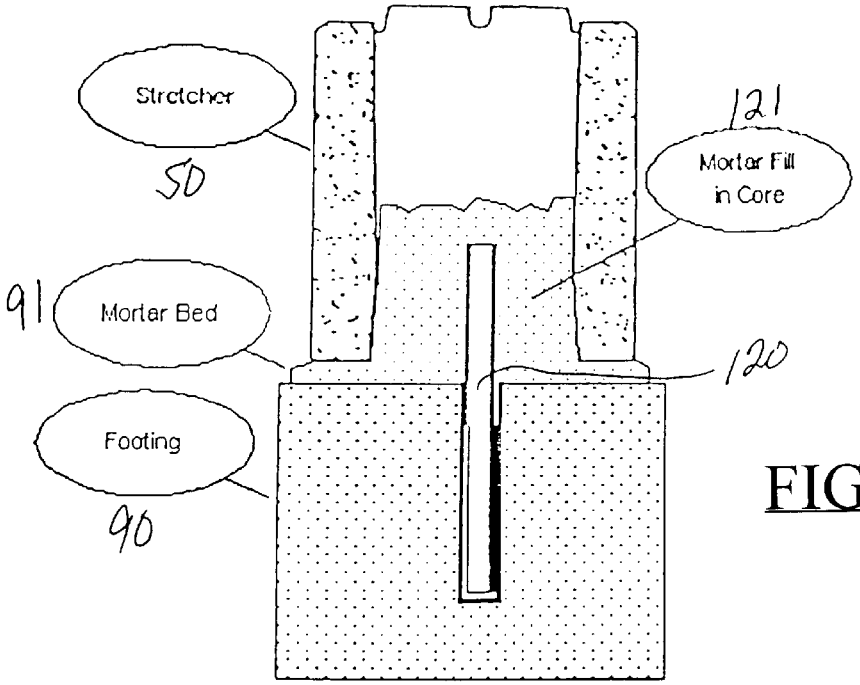
FIG. 29A
FIG. 29B
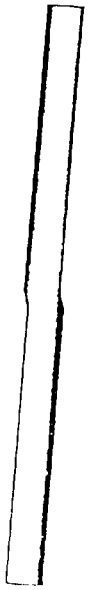
120
Off-Set Masonry Spike

FLEXIBLE INTERLOCKING WALL SYSTEM

This is a continuation-in-part of U.S. patent application Ser. No. 09/290,635, filed Apr. 12, 1997, now U.S. Pat. No. 6,244,009, which is in turn a continuation-in-part of U.S. patent application Ser. No. 08/925,311, filed Sep. 8, 1997, now U.S. Pat. No. 5,899,040.

FIELD OF INVENTION

This present invention relates to an improvement in free-standing mortarless building structures and, in particularly, to a virtually mortarless interconnecting block system with unique dynamic properties.

BACKGROUND OF THE INVENTION

Typically speaking, free-standing masonry walls are constructed of concrete blocks (or similar material) in running courses. Each course is placed in such a manner so that the vertical joints are staggered from e previous course. Mortar is used as a binding agent between the courses between the ends of each of the blocks. Conventional concrete blocks typically have one or more voids extending through them in the vertical direction to create vertical columns through the walls. Reinforcing bars are placed in these columns for enclosure within a continuous mortar masses within the columns, in accordance with building code standards. Such columns typically are placed approximately four feet apart along the length of the wall.

Although this type of free-standing masonry wall has been used successfully in residential, commercial and industrial construction, it possesses a considerable number of drawbacks. These include: the necessity of skilled labor for assembly (not handyman friendly), the requirement of mortar as a binding agent between each of the components, the considerable time demanded for construction, the inability to disassemble components and reuse if desired, the incapacity to absorb external pressure changes (such as settling, hydrostatic pressure and seismic disturbances) without significant deterioration to the structural integrity.

Several types of blocks and wall systems have been proposed to overcome some of these deficiencies. Beginning in 1901, U.S. Pat. No. 676,803 to Shaw, disclosed an interlocking block system that employed a combination of tongues and groves along with dovetails to secure each block to the adjacent blocks. This was followed by similar designs in U.S. Pat. No. 690,811 to Waller, U.S. Pat. No. 748,603 to Henry; U.S. Pat. No. 868,838 to Brewington; U.S. Pat. No. 1,562,728 to Albrecht; U.S. Pat. No. 2,902,853 Loftstrom; and, French Patent No. 1,293,147. Although the use of interlocking male and female dovetails provide a positive lock and represent a significant improvement over similar tongue and grove construction, all of the dovetails used in this conventional art embody a critical disadvantage in terms of assembly. When these are employed (as in the case of: U.S. Pat. No. 676,803; French Patent No. 1,293,147; U.S. Pat. Nos. 748,603; 1,562,728; and, 2,902,853) on the upper and lower surfaces of the block, the female dovetail of each new block must be slid over a number of male dovetails on the lower course into the appropriate position. Given the dimensional inaccuracies of common block material along with the tolerances necessary to slide the new block into place, binding is a frequent occurrence. Despite a long-felt but unresolved need for handyman friendly construction material, this frequent assembly problem, along with the various proprietary components, kept assembly to skilled professionals.

While much of the conventional art, to a certain degree, overcomes some of the difficulties associated with the requirement of mortar, and the inability to disassemble, none provide for the capacity to automatically absorb external pressure changes without significant deterioration in structural integrity. Attempts to address this particular problem have come in the form of steel reinforcement of some kind. In 1907, U.S. Pat. No. 859,663 to Jackson employed steel post, tension-threaded reinforcement rods in combination with steel frames to produce a very strong wall. The use of steel post, tension-threaded reinforcement rods can also be seen in: U.S. Pat. No. 3,378,96 to Larger; U.S. Pat. No. 859,663 to Jackson; U.S. Pat. No. 4,726,567 to Greenburg; U.S. Pat. No. 5,138,808 to Bengtson et al.; and, U.S. Pat. No. 5,355,647 to Johnson et al.

Unfortunately, this move to steel reinforcement as a means to counter external pressure meant the loss of many of the gains achieved by much of the conventional art. In short, the characteristics of: mortarless construction and the ability to disassemble components and reuse them were sacrificed for a stronger wall.

Although the addition of steel to bind the wall in a solid mass contributed to it structural integrity by better resisting certain external forces, this is only true in the case of a force applied in one direction against the wall. As in the case of hydrostatic pressure, the force moves only in one direction; from the outside to the inside, slowly and steadily. Seismic disturbances, such as those associate with earthquakes, tend to move the earth in a rapid back and forth motion. A wall bound as a sold mass is unable to accommodate the dynamic back and forth movement. Instead, its rigid composition directly transfers the force to the rest of the building (acting as sort of a lever) weakening the integrity of the entire structure until it finally fails.

Thus, it is desirable to provide a masonry wall system that incorporates the advantages of: unskilled labor for assembly; mortarless construction; the ability to disassemble and reuse; and, the necessary capacity to automatically absorb external pressure changes (particularly seismic disturbances) without significant deterioration of structural integrity. Such a wall system would create a new synergy that would satisfy a long-felt but unresolved need. It would also represent a positive contribution to the masonry industry.

SUMMARY OF THE INVENTION

Accordingly it is an object of the present invention to provide an improved masonry walls system that does not require skilled labor to assemble.

It is another object of the present invention to provide a masonry wall system that does not require mortar for it's construction.

It is a further object of the present invention to provide an improved masonry wall system that is capable of rapid, on-site assembly.

It is still another object of the present invention to provide an improve masonry wall system that can be disassembled and then reused. It is still an additional object of the present invention to provide an improved masonry wall system that overcomes the conventional problems of masonry assembly in which dovetail structures are used.

It is yet another object of the present invention to provide an improved masonry wall system that is capable of absorbing external pressure changes (such as settling, hydrostatic pressure and seismic disturbances) without significant deterioration in the structural integrity of the wall system.

It is yet a further object of the present invention to provide an improved masonry wall system that is capable of distributing stress on any portion of the wall throughout a large surrounding segment of the wall.

It is again another object of the present invention to provide an improved masonry wall system having a wide variety of interlocking schemes to facilitate flexibility in wall design and construction.

It is still a further object of the present invention to provide an improved masonry wall system that has superior earthquake-resistant properties to conventional masonry wall systems.

It is yet a further object of the present invention to provide a model system for an improved, mortarless wall system.

It is again another object of the present invention to provide a mortarless masonry wall system in which no vertical seams between adjacent blocks are lined from row to row, thereby strengthening the wall system.

It is still a further object of the present invention to provide a mortarless masonry wall system in which individual blocks interlock with each other, both vertically and horizontally, using self-contained structures.

It is an additional object of the present invention to provide a mortarless masonry wall system constituted by blocks which are easily handled, and quickly and efficiently assembled.

It is yet another object of the present invention to provide a mortarless masonry wall system which is flexible in order to compensate for external stresses on the wall such as seismic activity.

It is again another object of the present invention to provide a mortarless masonry wall system having adjustable degrees of flexibility once the wall has been assembled, without requiring changes in the size and structure of the individual blocks.

It is an additional object of the present invention to provide a mortarless masonry wall system admitting to easy insertion of insulating cords.

It is again a further object of the present invention to provide a mortarless masonry wall system which eliminates or greatly reduces point loading between blocks of the wall.

It is yet another object of the present invention to provide a mortarless masonry wall system admitting to varying degrees of adjustable flexibility, even after the wall has been entirely assembled.

It is again a further object of the present invention to provide a mortarless masonry wall system which is capable of extending its flexibility through the use of additional structures added after the wall is assembled.

It is an additional object of the present invention to provide a mortarless masonry wall system which relies upon only two types of different blocks, thereby simplifying production of the wall component and ease of assembly.

It is again a further object of the present invention to provide a mortarless masonry wall system having the capability of both flexing and returning to its original position after the removal of external stresses.

It is yet another object of the present invention to provide a mortarless masonry wall system which is flexible and avoids the necessity of forming rebar holes through the block constituting the wall.

It is still a further object of the present invention to provide a mortarless masonry wall system which easily drains water from the interior of the wall into drainage systems at the foot of the wall.

It is yet a further object of the present invention to provide a mortarless masonry wall system which includes internal spaces for conduit within the blocks constituting the wall without the necessity of cutting holes through the transverse walls of the block.

It is yet a further object of the present invention to provide a mortarless masonry wall system which is flexible but provides for horizontal structures such as lintels.

It is again another object of the present invention to provide a mortarless masonry wall system which admits to horizontal reinforcement through the adjustment of horizontal pressure on the blocks of the wall.

It is still another object of the present invention to provide a mortarless masonry wall system, and a technique for installing the wall system whereby the blocks of the wall are properly aligned to the footer supporting the wall.

It is still an additional object of the present invention to provide a mortarless masonry wall system in which the wall system is easily sectionalized and braced on a vertical basis for separating different stories for buildings employing said wall system.

It is again a further object of the present invention to provide a mortarless masonry wall system wherein reinforcement is easily added to the walls by virtue of metal reenforcing structures.

These and other objects and goals of the present invention are achieved by a flexible interlocking wall system including a plurality of blocks arranged for interlocking without mortar, where the wall system has at least two major surfaces, each major surface forming a wall face. The wall system includes a plurality of main blocks where each main block has at least one stabilizing slot. The stabilizing slot is positioned to be at lest partially vertically collinear with stabilizing slots in other vertically adjacent blocks when positioned with respect to each other in an interlocking configuration to form a wall face. Also included are a plurality of reinforcing tendons, each placed in a selected stabilizing slot through a plurality of the main blocks. Each of the reinforcing tendons is sized with respect to the stabilizing slot to permit movement of the main block along at least one horizontal plane for a predetermined extent in a direction perpendicular to at least one face of the wall. Each of the reinforcing tendons is connected inside the wall at one end and connected at the top of the wall at the other end.

BRIEF DESCRIPTION OF THE DRAWINGS

FIG. 1(*b*) is a perspective diagram depicting the rear view of the block of FIG. 1(*a*).

FIG. 3 is a perspective diagram depicting a corner block.

FIG. 4 is a perspective diagram depicting a short block.

FIG. 5 is a perspective diagram depicting a partially assembled wall using the inventive system.

FIG. 6 is a top view of the first course of a wall constructed according to the present invention.

FIG. 11(*b*) is a bottom view of the block of FIG. 11(*a*).

FIG. 11(*c*) is a top view of the block of FIG. 11(*a*).

FIG. 11(*d*) is an end view of another variation of the present invention.

FIG. 11(*e*) is an end view of still another variation of the present invention.

FIG. 12(*a*) is a perspective view of a corner block used in further embodiment of the present invention.

FIG. 12(*b*) is a front view of the corner block of FIG. 12(*a*).

FIG. 12(*c*) is a first end view of the corner block of FIG. 12(*a*).

FIG. 12(*d*) is a top view of the corner block of FIG. 12(*a*).

FIG. 12(*e*) is a bottom view of the corner block of FIG. 12(*a*).

FIG. 13(*b*) is a first end view of the corner block of FIG. 13(*a*).

FIG. 13(*c*) is a first side view of the corner block of FIG. 13(*a*).

FIG. 13(*d*) is a top perspective view of the corner block of FIG. 13(*a*).

FIG. 13(*e*) is a bottom perspective view of the corner block of FIG. 13(*a*).

FIG. 14(*b*) is a detailed view of FIG. 14(*a*).

FIG. 14(*c*) is an additional detailed view of FIG. 14(*a*).

FIG. 17(*b*) is a side view of the block of FIG. 17(*a*).

FIG. 17(*c*) is a side view of the block of FIG. 17(*a*), depicting additional inventive features.

FIG. 18(*b*) is a front view of the block of FIG. 18(*a*).

FIG. 18(*c*) is a side view of the block of FIG. 18(*a*).

FIG. 19(*a*) is a bottom perspective view of the bottom of the block of FIG. 17(*a*).

FIG. 19(*b*) is a top perspective view of the block of FIG. 17(*a*).

FIG. 19(*c*) is a perspective view, taken at a different angle from that of FIG. 19(*b*).

FIG. 19(*d*) is a perspective view taken at a different angle of the block of FIG. 19(*a*).

FIG. 20(*a*) is top perspective view of the corner block of FIG. 18(*a*).

FIG. 20(*b*) is a bottom perspective view of the corner block of FIG. 18(*a*).

FIG. 20(*c*) is a bottom perspective view taken at a different angle of the block of FIG. 20(*a*).

FIG. 20(*d*) is a top perspective view taken from a different angle of the block of FIG. 20(*b*).

FIG. 21(*b*) is a perspective view from a different angle of FIG. 21(*a*).

FIG. 21(*c*) is an additional perspective view of the block arrangement of FIG. 21(*b*).

FIG. 21(*d*) is an additional perspective view of the block configuration of FIG. 21(*a*), taken from another angle.

FIG. 22(*b*) is a top view of two horizontally adjacent blocks such as those depicted in FIG. 19(*a*).

FIG. 22(*c*) is a top view incorporating the block arrangement of FIGS. 22(*a*) and 22(*b*).

FIG. 23(*b*) is a perspective view of the block arrangement of FIG. 23(*a*), taken from a different angle.

FIG. 23(*c*) is a side view of a stack of blocks, such as those depicted in FIG. 17(*a*).

FIG. 24(*b*) is a top view of the arrangement of FIG. 25(*a*).

FIG. 24(*c*) is a side view of FIG. 24(*a*).

FIG. 28(*b*) is a detailed view of the tool depicted in FIG. 28(*a*).

FIG. 29(*a*) is a sectional side view of a block mounted on a footing.

FIG. 29(*b*) is a detailed view of a reenforcing rod found in FIG. 29(*a*).

FIG. 30(*b*) is a detailed view of the tool depicted in FIG. 30(*a*).

DETAILED DESCRIPTION OF THE PREFERRED EMBODIMENTS

Figure 1A:
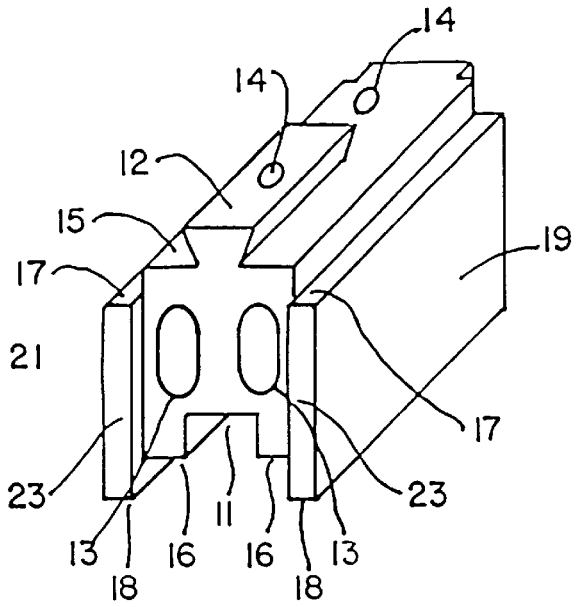
FIG. 1(*a*) is a perspective diagram depicting the main block component of the inventive wall system.
Figure 1B:
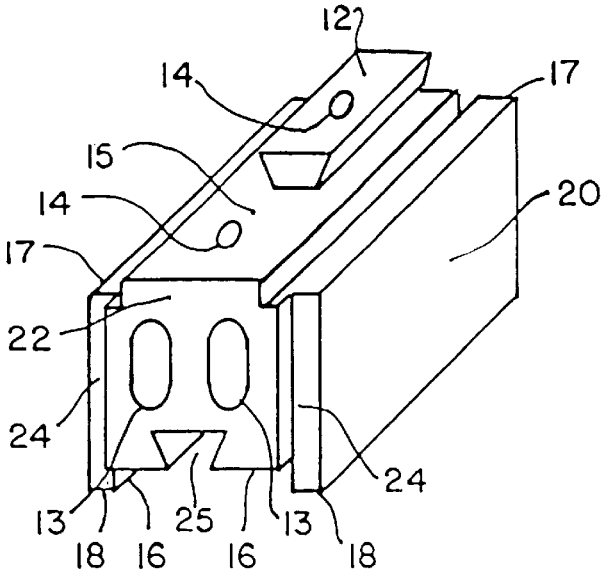

FIGS. 1(*a*) and 1(*b*) depict two perspective views of the main block constituting the present invention. The drawing designation numerals included in FIGS. 1(*a*) and 1(*b*) remain the same for all of FIGS. 1(*a*)–10. For the sake of clarity and efficient consideration of all of the drawings, the legend of the drawing designation numerals is provided below:

| | | | |
|---|---|---|---|
| 11. | square receiving slot | 21. | front plane |
| 12. | dovetail | 22. | rear plane |
| 13. | through holes | 23. | front shoulder |
| 14. | stabilizing holes | 24. | rear shoulder |
| 15. | upper plane | 25. | dovetail receiving slot |
| 16. | lower plane | 26. | corner block |
| 17. | upper shoulder | 27. | cynderbrick (main block) |
| 18. | lower shoulder | 28. | short block |
| 19. | interior sides | 29. | footer |
| 20. | exterior sides | 30. | foundation |

The wall system of the present invention is essentially composed of three basic components. These include: a main block, a corner block, and short block. The main block, shown in FIGS. 1(*a*) (front view) and 1(*b*) (rear view), is the fundamental component upon which the entire wall system is based. It is rectangular in its general shape and possess a number of crucial features that set it apart from the conventional art. Situated on the upper plane 15 is a male dovetail 12 extending up from the front plane 21 and back to approximately one-half the length of the cynderbrick. Running along the lower plane 16, parallel to the male dovetail 12 on the upper plane 15, is the combination square receiving slot 11 and dovetail receiving slot 25. The square receiving slot 11 runs approximately one-half the length from the front plane 21 and then gradually turns into the dovetail receiving slot 25.

This feature enables a new main block to be placed directly over the top of a main block on the lower course. Here, the square receiving slot 11 of the main block freely receives the dovetail 12 of the main block on the lower course. The new main block is then slid one-half its length so that, as the square receiving slot 11 turns into dovetail receiving slot 25 on the new main block, it engages the male dovetail 12 on the main block on the lower course and is locked into position staggering the vertical joints. This feature overcomes the assembly difficulties found in prior art where each new block must be slid over a number of other blocks on the lower course into the appropriate position. It is also easier to fit the blocks of the present invention onto other such blocks than with similar conventional art interlocking wall systems. This is due to the fact that the tolerances between the dovetails and the dovetail slots of the present invention are quite large so that there is easy assembly. The use of large tolerances between the interlocking pieces has benefits that are explained infra. On the other hand, in conventional interlocking wall systems, the tolerances between the slots and pieces that are meant to extend into the slots are quite small. The resulting tight fits are necessary for the proper assembly of such conventional art walls but make the assembly quite difficult. This drawback is not shared by the system of the present invention.

Figure 8:
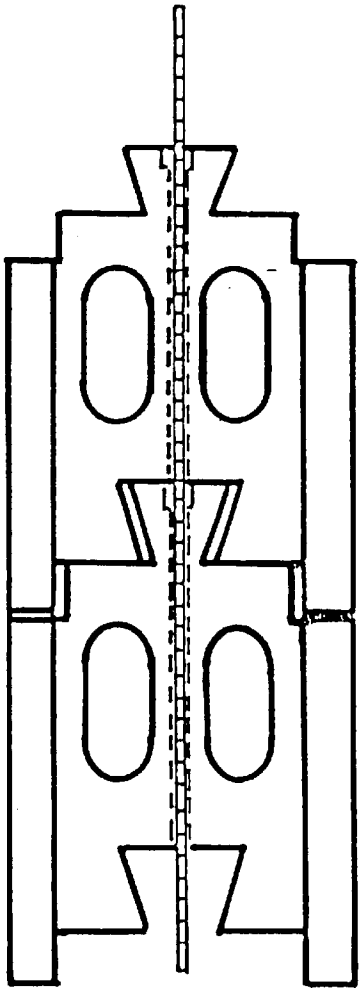
FIG. 8 is a cross sectional view of the structure of FIG. 7 under different external conditions.
Figure 7:
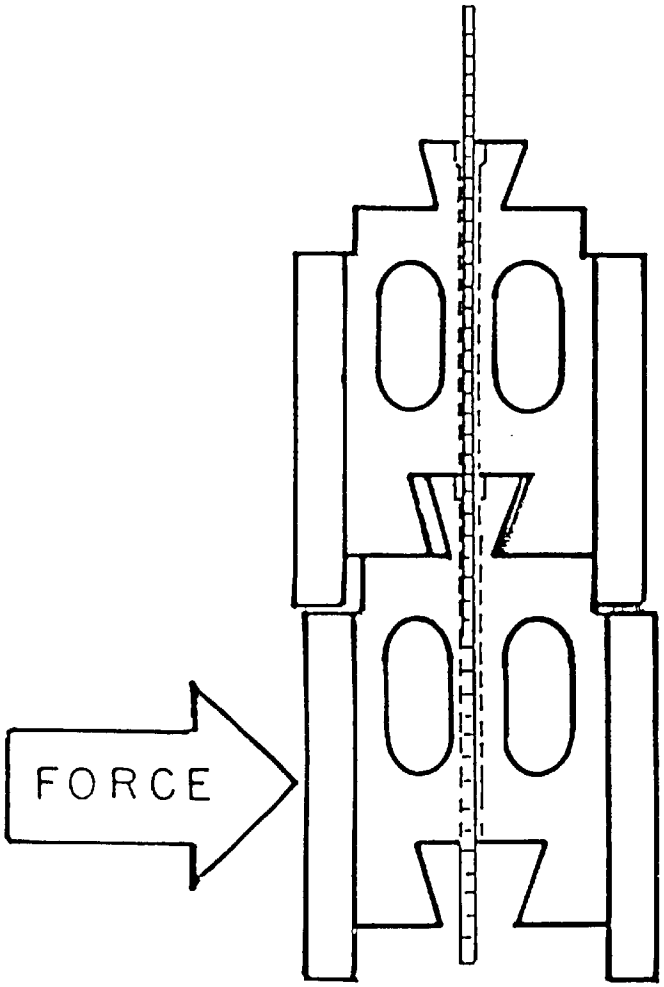
FIG. 7 is a cross sectional view of a portion of a wall assembled according to the present invention, under 1 set of external conditions.
Figure 9:
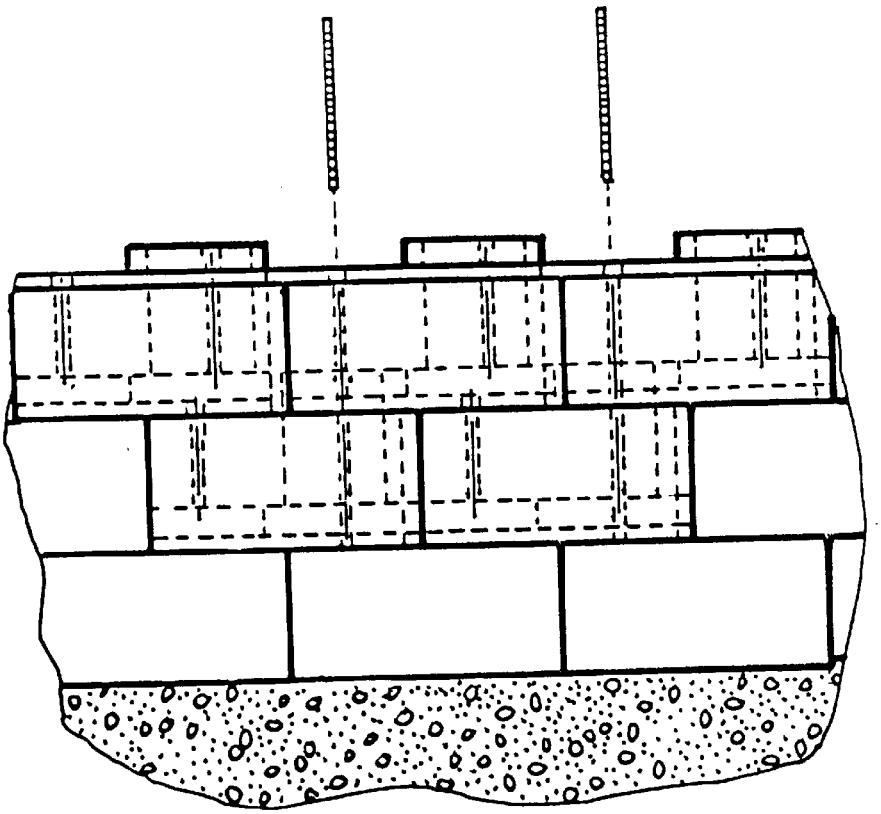
FIG. 9 is an elevation view of the wall according to the present invention, depicting placement of reinforcement rods.

The sides of the main block 19, 20 are off-set (in a parallel manner) both horizontally and vertically creating interlocking shoulders 17, 18, 23, 24 when mated to adjacent blocks. This provides the blocks with horizontal and vertical stability. The lower shoulder 18 also acts as a drip edge resisting water penetration. Running at a vertical axis through the center of the main block are two stabilizing holes 14. These hole loosely accommodate either steel reinforcement rods or square tubing as shown in FIGS. 7, 8 and 9. Optional through holes 13 may be added to reduce the amount of cement and/or other material used to manufacture the component.

Figure 2:
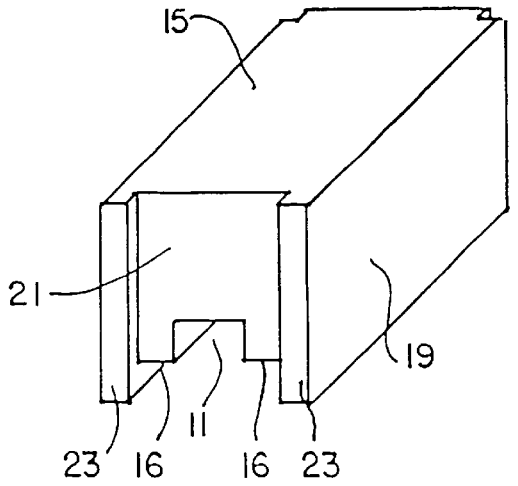
FIG. 2 is a perspective diagram depicting a sill cap.

Both the corner block shown in FIG. 3 and the short block shown in FIG. 4 employ the same features as the main block with the exception of the interlocking dovetail. The interconnection of these components is illustrated in FIGS. 5 and 6. A sill cap, as depicted in FIG. 2 is employed over the top of the last course to help lock the course of blocks into place, and to provide a surface for subsequent framing if required.

While the aforementioned blocks may appear similar to those found in the conventional art examples, the differences that have been pointed out are very significant with respect to the manner in which the wall operates to distribute external stress. While all interlocking blocks possess some play by virtue of the tolerances necessary to interconnect them, none possess the attribute of variable dynamic resistance. The term, dynamic resistance, can be defined as the property of a structure to slightly give under pressure and then lock up as a solid mass at a given point. Thus, variable dynamic resistance is dynamic resistance that can be adjusted to suit construction and environmental requirements.

The operation of this property is effected by a combination of block fit tolerances and the use of either steel reinforcement rods or square tubing loosely placed through the stabilizing holes 14 at the top. By changing the number of rods and their placement, a considerable degree of variation can be achieved. Simply put, more rods in more places means less fluidity and more rigidity. Conversely, fewer rods in fewer places means more fluidity and less rigidity. This property substantially increases wall integrity and reduces the common cracking found in contemporary wall construction. Also, the tolerance between the stabilizing hold and the forcing rods can also be adjusted to adjust the degree of wall movement permitted.

Figure 10:
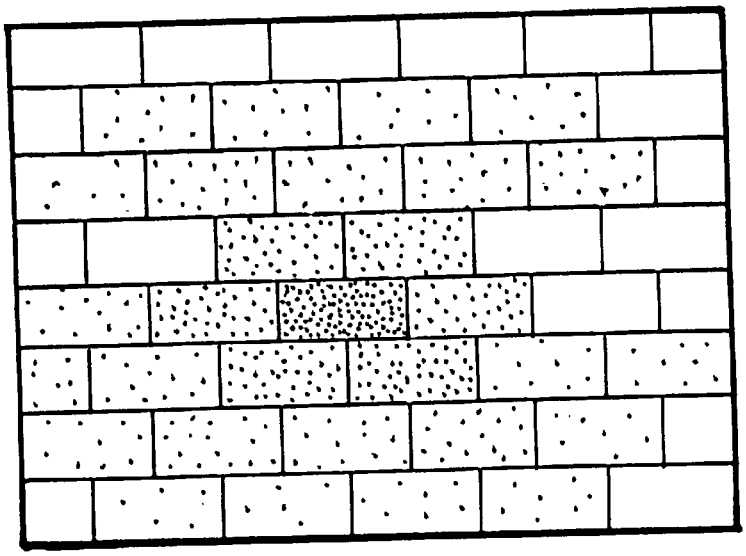
FIG. 10 is an elevation view depicting the distribution of force on a wall according to the present invention.
Figure 11A:
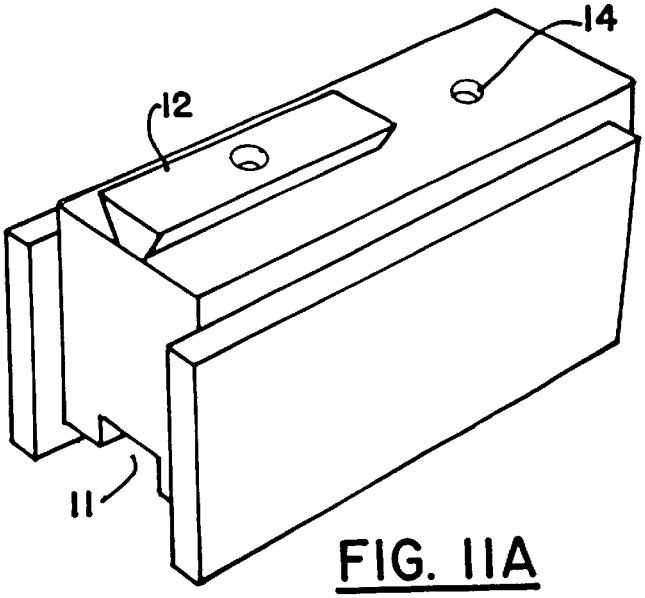
FIG. 11(*a*) is a perspective view of a main block used in another embodiment of the present invention.
Figure 11B:
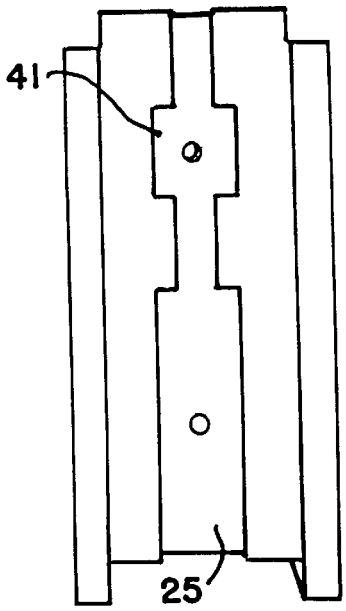
Figure 11C:
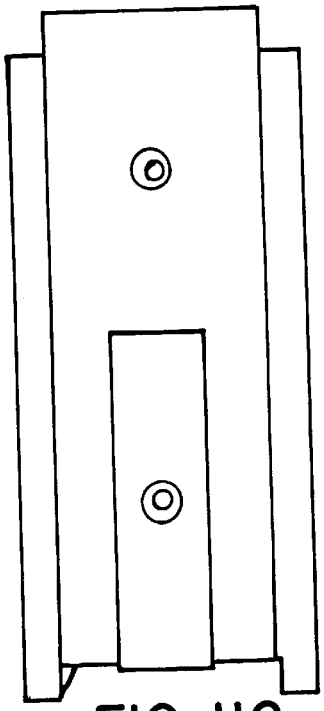
Figure 11D:
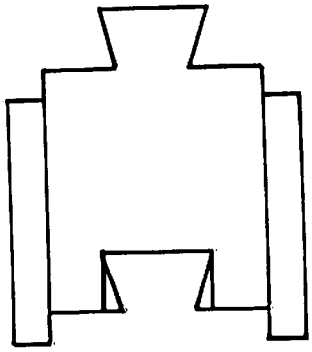
Figure 11E:
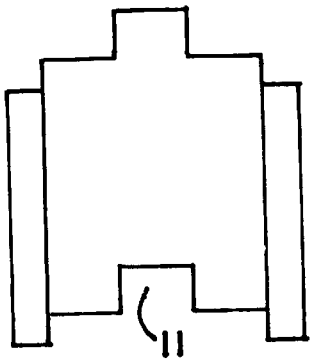
Figure 13A:
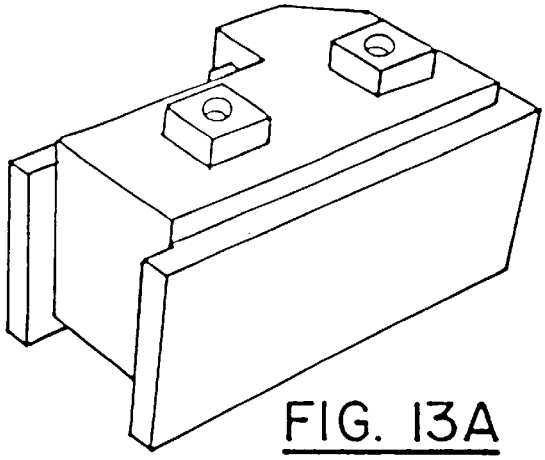
FIG. 13(*a*) is a perspective view of a corner block of another embodiment of the present invention.
Figure 13B:
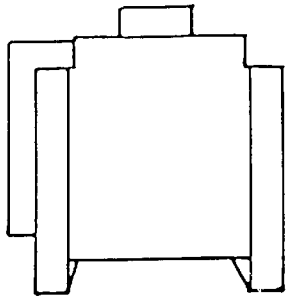
Figure 13C:
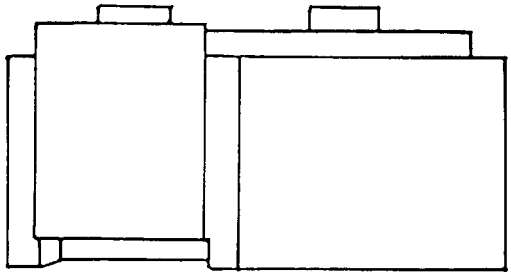
Figure 13D:
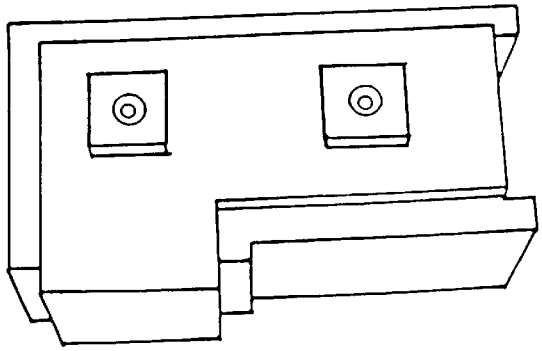
Figure 13E:
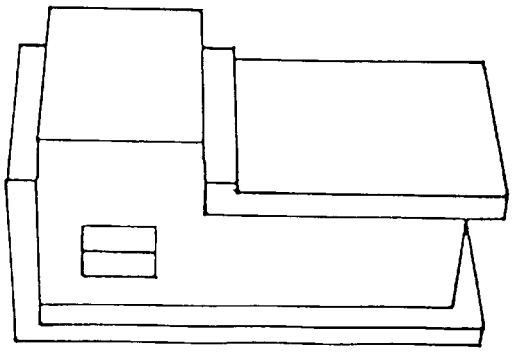

When forces such as hydrostatic pressure are exerted against the wall surfaces, each cynderbrick moves slightly. The first movement occurs proximate to the pressure. As this block moves to its predetermined tolerance (when the dovetail jambs against the side of the slot and the reinforcing rod jambs against the side of the whole containing it), it automatically locks in place and then transfers this force to the six adjacent blocks (two top, two bottom and two sides, see FIG. 10). These blocks likewise move a predetermined extent until they reach the end of their tolerance and then they, in turn, transfer the force to the other adjoining blocks. This allows the entire wall to progressively and systematically absorb the force moving gradually as it does. This radial transfer is illustrated in FIG. 10 where the darker areas represent the greater degree of stress and earlier lock-up in the progression.

Strategically placed within the wall are either steel reinforcement rods or square tubing as seen in FIG. 9. These run in a vertical fashion and are used to stabilize the wall when it reaches the end of its tolerance and locks up. Unlike all of the conventional art, the steel reinforcement rods or square tubing are loosely placed with the vertical holes as depicted in FIG. 8. This space between the hole and the reinforcing rod (along with the tolerance between the block dovetails and their associated slots) permit movement of the wall up to a point. This is when the side of the dovetail jambs tight against the side of it's respective slot and the reinforcing rod jambs tightly against the hole through which it is placed. Thus, these elements act in conjunction to provide controlled movement and positive lock-up.

When the wall is in locked-up state, all of the blocks have reached the end of their predetermined tolerances and the force is now transferred to either the steel reinforcement rods or the square tubing as shown in FIG. 7. This transfer is possible because the space between the steel reinforcement rods and the vertical holes in the cynderbricks are reduced as a result of the block movement up to this point. The reinforcing rods now act to stabilizing the structure. This, in turn, further limits the movement of the wall and positively acts to resist the applied pressure. Because of the interlocking dovetails and the manner in which the horizontal and vertical surfaces connect, each block contributes to resist the force. Thus, the present structure operates to distribute the force on any particular block or blocks, as depicted in FIG. 10. As a result, instead of all the force being placed upon the block (depicted as the darkest block in FIG. 10), the force is distributed to surrounding blocks and in diminishing measure to those blocks surrounding them. By spreading the force as depicted in FIG. 10, it is far less likely that sufficient stress will be built up on one block or group of blocks to cause the wall to fail at a particular point. This makes the wall a strong interconnected mass able to withstand far more force than its traditional counterparts.

There are five factors that contribute to the property of variable dynamic resistance. These can be divided into two general categories: fixed and variable. The fixed factors are those designed within the system and cannot be altered unless the dimensions are modified. These include the overall size of the cynderbrick, the tolerance between each cynderbrick and the size of the stabilizing holes. The variable factors are those that can be adjusted by the assembler. Among these are: the number and placement of the either the steel reinforcement rods or the square tubing.

The unique physical characteristics of the masonry components, working in conjunction with the loosely placed rods/tubing, produces the highly efficient distribution of force over a large segment of the wall, enabling the wall not only to accommodate gradual directional forces such as settling and hydrostatic pressure, but rapid omnidirectional forces such as seismic disturbances. The wall structure which facilitates the property of variable dynamic resistance, creates a technique for dealing with omnidirectional external pressures.

The flexible walls of the present invention can accommodate the movements found in earthquake zones. In contrast, the rigid conventional walls, such as those found in residential foundations, will directly transfer the seismic force to the rest of the building cumulatively weakening the integrity of the structure until it eventually fails. Not only does the present invention overcome this significant problem, but it also has the added features of:

(a) providing an improved masonry wall system that does not require skilled labor to assemble;

(b) providing an improved masonry wall system that is mortarless in construction;

(c) providing an improved masonry wall system with rapid on-site assembly;

(d) providing an improved masonry wall system that can be disassembled and reused;

(e) providing an improved masonry wall system that overcomes the problems commonly associated with dovetail assemble.

It will be understood by one skilled in this art that any number of different configurations of front shoulders, rear shoulders, upper shoulders and lower shoulders (17, 18, 23, 24), as well as other related interlocking structures can be used within the scope of the present invention. Further, any combination of square receiving slots 11 (in FIG. 11(*e*)) and dovetail receiving slots 25 can be used. One example is found in FIG. 11(*d*) which depicts the combination of a square slot for easy fitting of two adjacent blocks and a dovetail receiving slot 25 to more closely hold the two adjacent blocks together.

The embodiment of FIGS. 11(*a*)–11(*d*) differs from that previously described by virtue of a second receiving aperture 41, which is designed to hold an upper connecting stud 42 such as that depicted in FIG. 12(*a*). The embodiment of FIG. 11(*a*) can include dovetail 12 as an upper interlocking device, or can use a rectangular structure as in FIG. 11(*e*) in lieu of the dovetail.

FIGS. 12(*a*)–12(*e*), as well as FIGS. 13(*a*)–13(*e*) depict two additional embodiments of the present invention. All of the blocks depicted in these drawings are corner blocks. The blocks of FIGS. 12(*a*)–12(*e*) and those of FIGS. 13(*a*)–13(*e*) are meant to alternate with each other so as to create a staggered vertical seam at the interface of the corner blocks and the main blocks.

An alternative to dovetail 12 or a rectangular key structure, interconnecting studs 42 (as depicted in FIG. 12(*a*)) can be substituted. Either one such stud or two, as depicted in the drawings can be used where appropriate. The use of the connecting studs rather than the elongated dovetail structure or elongated dove structure can often make assembly of the blocks easier. This can be especially important when trying to alternate between different types of corner blocks (such as those depicted in FIGS. 12(*a*)–12(*e*) and 13(*a*)–13(*e*)) in order to avoid a vertical seam line on either side of the corner blocks. The avoidance of this seam line is especially important in further strengthening the wall system.

It should be evident to one skilled in this art that virtually any configuration of wall block can be used within the concept of the present invention in order to provide the desired configuration of the various blocks depicted in the drawings, as well as those having other interlocking configurations that would occur to one skilled in this art.

The blocks can be made of any masonry material including cellular concrete or other light weight materials such as the auto-clave, aerated concrete used in many structural materials. This will allow the system of the present invention to be used in a wide variety of different structural applications.

Further, the blocks used in the present invention can be molded or otherwise formed to include conduit runs, ventilation connections or any other configuration to accommodate other building materials to be used with the wall system. Consequently, the wall system of the present invention can be configured to accommodate all of the structures that might be used as part of a building which includes the present invention. Such formations can also include aesthetic features, such as colors, different textures for the surface of the wall, and even base-relief designs.

Because the concept of the present invention can be carried out using a number of different materials for the blocks, the wall system of the present invention can be down-scaled to be used for modeling purposes, or even as toys. Accordingly, the materials used to manufacture the blocks are to be of sufficient density to accommodate the various shapes of the blocks on a scale appropriate for toys or models. While even cellular concrete may not be appropriate for this application, other materials can be used. For example, plastic, rubber or even wood can be used to duplicate the inventive wall system for purposes of creating working models or toys.

When the present invention is used in a model or toy application, the reinforcing rods depicted in FIGS. 7 and 8 can be made of a number of different materials since structural steel would not be required for such applications.

For example, the rods can be made of elongated plastic or rubber. In order to simulate the actual variable dynamic resistance of the present invention, the rods are preferably made of a flexible metal material, even for modeling or toy applications.

Figure 15:
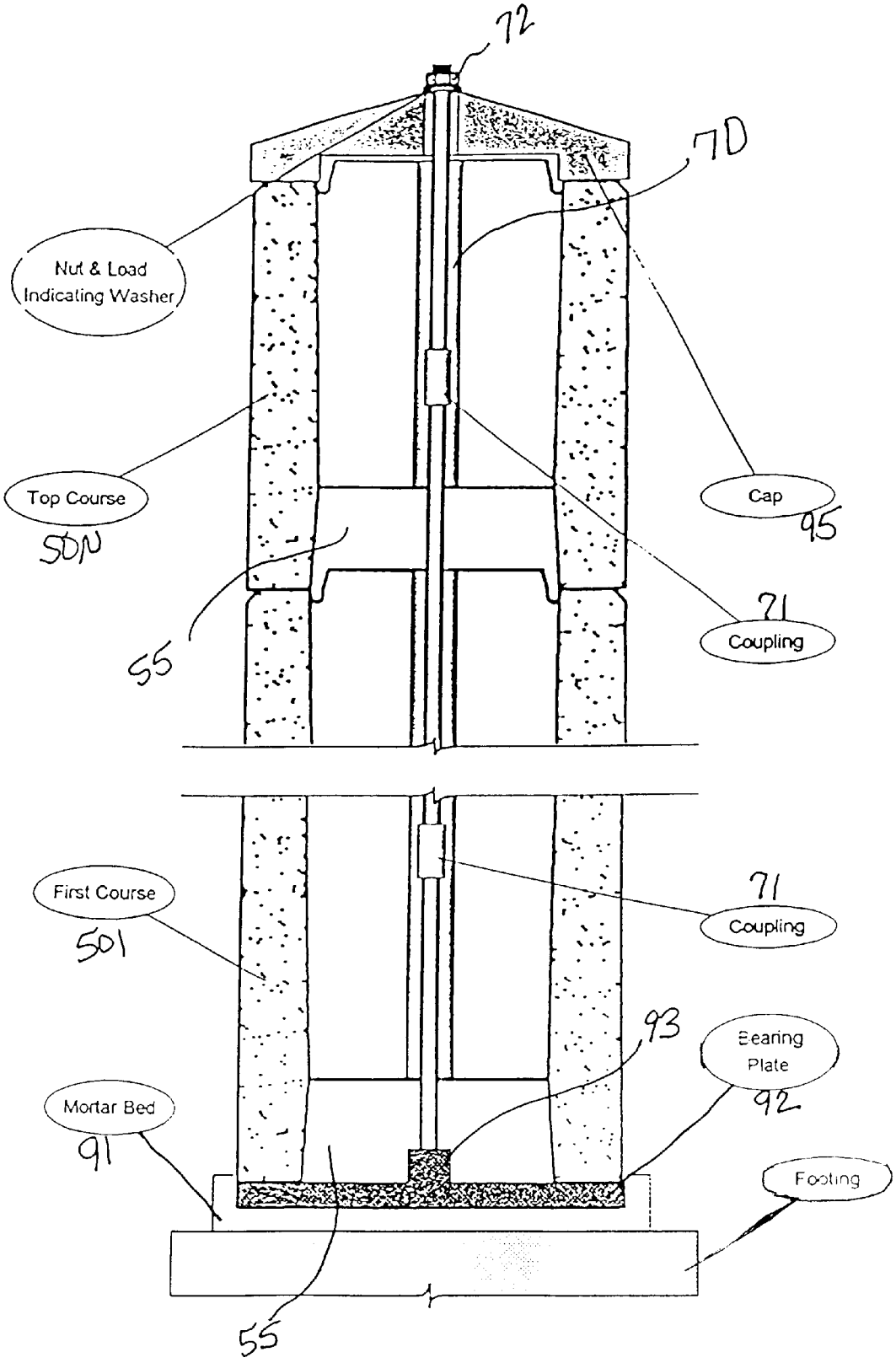
FIG. 15 is an end, cut-away view of a wall system incorporating a plurality of blocks similar to those depicted in FIG. 14(*a*).
Figure 16:
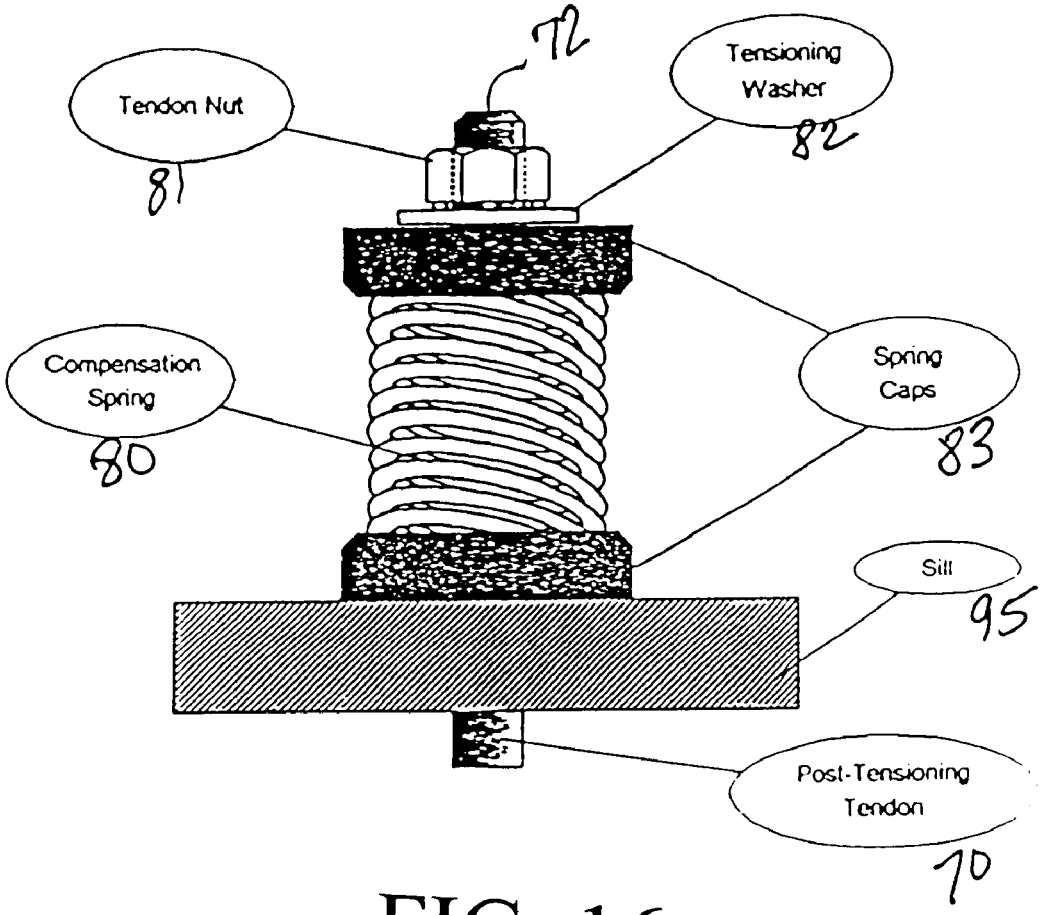
FIG. 16 is a side view of an additional element constituting the wall system of FIG. 15.

The reenforcing rods can be further made more effective and hold the wall system together more throughly from top to bottom if the rods are threaded at both ends is described infra with respect to FIGS. 15 and 16. This would allow the lower part of the rod to be threaded into a threaded receiving piece formed into the concrete foundation, such as bearing plate 92 in FIG. 15. The upper end of the reenforcing rod would also be threaded to allow a nut to hold a plate, such as cap 95, to the top of the wall. Such an arrangement would make the wall system more able to withstand the stresses caused by earthquakes and other massive disruptions. The tightness of the bolted plates at the top of the wall should be adjusted depending upon the amount of movement that would be considered desirable for the wall system.

Further stability could be obtained by forming a templet (preferably of masonry material) as part of the foundation on which the wall of the present invention would be placed. Such a templet could have the configuration of upper interlocking structures depicted in the drawings. Such interlocking structures on the templet would interlock with the lower interlocking structures of the first row of blocks of the wall, thereby forming a more stable structure. In the alternative, such a templet could be formed separately, and include only as much material as is necessary for the basic interlocking between adjacent blocks. Such a templet could be bolted directly to the foundation in a manner well known to those skilled in the art so that the first course of full blocks would be interlocked onto the templet. To facilitate ease of installation and flexibility in assembling the wall system, the templet could be made of a number of materials other than the masonry used to form the main part of the wall system. For example, the templet could be made of metal (preferably rust-resistant), hard rubber, nylon, plastic, or even pressure-treated wood.

The previously-described embodiment provides an entirely new concept in terms of masonry wall resiliency. However, certain problems of masonry walls require further modification. In particular one particular problem is the occurrence of point loading due to nonuniformity in masonry block construction. Traditionally, dry, stacked blocks have been unsuccessful in maintaining consistency because standard block molding machines lack the capability of uniform construction. Because certain parts of the block, such as the flanges, protrude, phenomenon called point loading occurs. One example is when a protrusion on a flange due to nonuniform construction becomes the sole point upon which the flange of the block rests upon the block below it. This significantly reduces the structural integrity of the wall, as well as rendering accurate leveling and sizing of the wall very difficult. This is especially problematical with walls of the present invention since the mortar which is used to achieve level uniform walls is not used to connect vertically adjacent blocks in the wall system of the present invention. Accordingly, only the top cap which is connected to the top row of blocks using mortar or grout can conventionally be used to level the wall in attempt to achieve a uniform height.

Figure 14A:
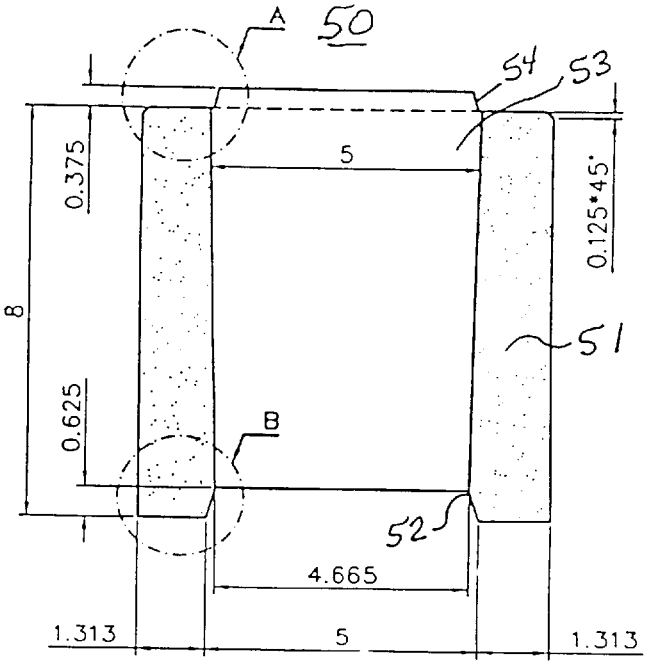
FIG. 14(*a*) is an end view of the positional variation of a masonry block having further aspects of the present invention.
Figure 14B:
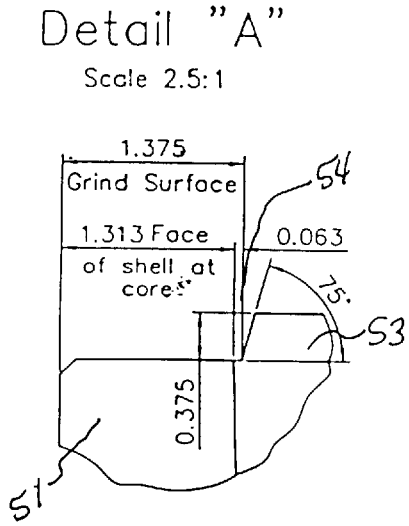
Figure 14C:
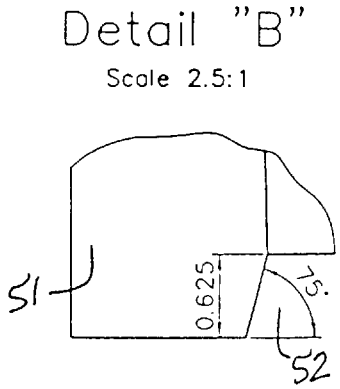

To address this problem, an additional embodiment of the present invention uses blocks (depicted in FIGS. 14(*a*)–14(*c*)) that have ground bearing surfaces to obtain uniformity, and avoid point loading. A close fit for vertical interlocking between adjacent blocks 50 is provided by grinding the upper surface of flanges 51. Also, surface 54 on interior web 53 is molded to interface closely with surface 52 of flange 51. Both surfaces 54 and 52 are molded to achieve an angle of 15° from vertical. A typical arrangement that has been used includes an extension of interior web 53 approximately 0.375 inches above flanges 51 at the top of block 50. The flanges extend approximately 0.625 inches beyond the interior web 53 at the bottom of the block. These dimensions are typical for a block approximately 0.375 inches tall, and approximately 7.726 inches wide. These are dimensions substantially consistent with standard CMU-sized blocks.

The normal molding process for masonry blocks can insure that proper tolerances are maintained on all surfaces and edges, except for the top edge of flange 51. In the normal molding process the upper surface of flange 51 is subjected to variances of up to 1/16 of an inch, and can result in the aforementioned irregularities. The other portions of the block are contained within the mold, and so are not subjected to this problematical situation. Accordingly, it is only the upper edge of flange 51 that must be ground in order to achieve a close fit with a vertically adjacent block. It should be noted that the bottom surface of flange 51 is subjected to tight mold tolerances, and so does not suffer from the aforementioned variance.

The grinding is preferably done at the factory once the block is molded, or can be carried out in the field immediately before installation of the blocks. As a result of this grinding operation, vertically adjacent blocks fit together in and are vertically supported along the entire top and bottom of the flange 51, as well as the molded 15° beveled surface 54 interfacing with 15° beveled surface 52.

It should be noted that while the aforementioned dimensions are suitable for blocks of the CMU standard size, this embodiment of the present invention is not limited thereto. The benefits of this embodiment of the present invention can be obtained with smaller or larger blocks, and with beveled surfaces, either greater or less than 15°. The key requirement is that the beveled surfaces be uniform along with the upper surfaces and lower surfaces of flanges 51. The interfaces of the beveled surfaces provide a high degree of flexible interlocking between vertically adjacent blocks.

The interlocking of the previously-described embodiment has certain constraints. If the interface between the beveled surfaces is made extremely tight, and within narrow tolerances, the capability of the wall to properly flex under external stresses may be somewhat compromised. Accordingly, tolerances for the aforementioned embodiment should be only as close as necessary to achieve a lose interlock. A tight interlock is not effective if the wall is to flex to any substantial degree. Control of such flexing must be based upon the use of the support structures described with respect to the previous preferred embodiment (FIGS. 1–13) of the present invention.

The reenforcing capability of these rod-like structures can be extended using the arrangement of FIGS. 15 and 16 in a further embodiment of the present invention. The reenforcing structures are preferably very similar to standard metal (iron or steel), which is a standard reenforcing device in conventional wall systems. However, unlike conventional rebar, or the support structures of the previous preferred embodiments of the present invention, the support tendons 70 are threaded at at least one end, and attached to the wall system at both ends. By tightening the nut 81 (FIG. 16) against a lintel or cap 95, while connecting support tendons 70 at its other end to a bearing plate 52 at the bottom of the wall, vertical pressure is exerted throughout the vertical courses of blocks 501–50N of wall 100.

By increasing or decreasing the tension on the top cap or lintel 95 through nut 81, the tightness of supporting tendon 70 within apertures in the block 50 can be adjusted. This tension is most easily adjusted through the use of compensating spring 80, which is held between spring caps 83. The spring caps rest upon sill 95 so that force created by tightening nut 81 is transmitted through the cap 95 and into the block 50N–501 as vertical force. This vertical force can control how much flexing is permitted by the block of the wall. The tension created by tightening or loosening nut 81 on threaded portion 72 of tendon 70 will determine to a large extent how far the blocks can move in a horizontal direction before locking up with the tendons 70, as described with respect to the previous embodiments (FIGS. 1–13) of the present invention. The use of spring 80 also increases the amount of external force the wall 100 can absorb without damage.

However, with the previous embodiments (FIGS. 1–13) of the present invention, only a certain amount of flexing is permitted, and this is determined by the size of the tendon and the size of the holes in the block through which the tendon passes. Once the blocks have been manufactured and assembled into the wall, no adjustments of the degree of flexing permitted can be carried out without massive structural changes in the wall.

This instant embodiment (FIGS. 15 and 16) of the present invention permits for adjustments in the degree of wall flexibility after the wall has been erected, without reassembling the wall or changing the sizes of the apertures through which the tendon passes, or the tendons themselves. Through the use of the embodiment depicted in FIGS. 15 and 16, the amount of wall flexing can be adjusted, and the force under which the wall flexes can also be more precisely determined. The fact that forces on the wall are ultimately absorbed by the spring 80, means that the wall becomes more resilient, and is more likely to move back to its original position when the external forces are removed. This is especially helpful when walls having the present invention are subjected to seismic forces.

In order to achieve the tensioning of the wall in the vertical direction through the use of tendon 70, it is necessary that the tendons be connected at its second end to a structure at the base of the wall. It is necessary that the structure be arranged so that the vertical forces generated by tension on the tendon be transmitted upward vertically. In the preferred embodiment of FIGS. 15 and 16, this is provided by a bearing plate or base plate 92 at the bottom of the lowest block 501 in the vertical stack through which tendon 70 passes. Preferably, tendon 70 has a threaded portion 72 at both ends. At the lower end, threaded portion 72 is screwed into threaded receptacle 93 of the bearing plate 92.

While this is the preferred method of carrying out this particular aspect of the invention, it is not absolutely necessary. Instead tendons 70 can be set into a mortar bed 91 which does not contain bearing plate 92. The mortar bed is supported by footing 90. Pressure is applied to the opposite end of tendon 70 through tightening nut 81 against washer 82 and spring caps 83 to create the vertical force through cap 95. However, this alternative arrangement is not nearly as stable or easy to implement as that depicted in FIG. 15. While a mortar connection for the lower end of tendon 70 has been shown to be adequate for the previous embodiments (FIGS. 1–13) of the present invention (where movement of the blocks is eventually stopped entirely by a locking action with tendons 70), this connection arrangement is not nearly as effective when applying tension through tendon 70 by the tightening of nut 80 to create vertical forces throughout the wall 100. Accordingly, a metal (preferably steel or iron) bearing plate 92 is preferred.

Since extremely long pieces of rebar are conventionally used, they are extremely awkward to handle. Because tendons 70 have threaded portions 2, shorter portions of the tendons can be used for the sake of easier handling. For tall wall sections the tendons are connected to each other using couplers 71. This is easily accomplished due to the threaded portion 72 of the tendons.

The assembly of tall walls leads to additional problems. Even if assembly of the tendons has been simplified through the use of threaded couplers 71, there are still problems with fitting blocks 50 on top of each other by passing a fixed tendon 70 through a hole in the block. Further, blocks such as those shown in FIGS. 1–14 can be awkward to handle when placing one block on top of another due to a lack of easy hand holds on the block. This is especially critical when fitting blocks over tendons to create tall walls of block.

Figure 17A:
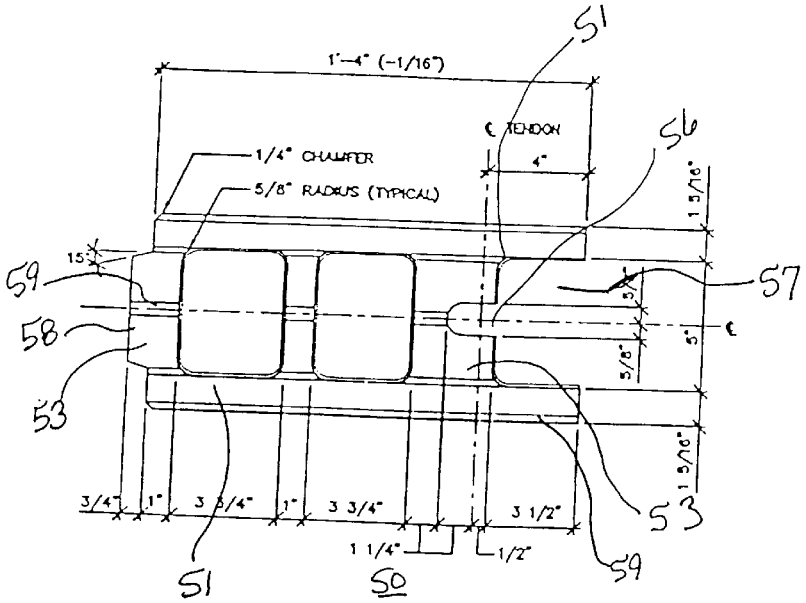
FIG. 17(*a*) is a top view of an additional block embodiment having inventive features, and used in the context of the original invention.
Figure 17B:
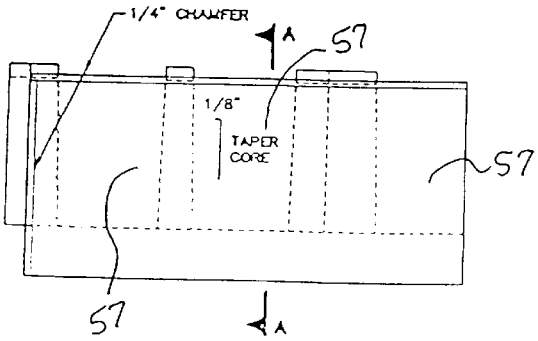
Figure 17C:
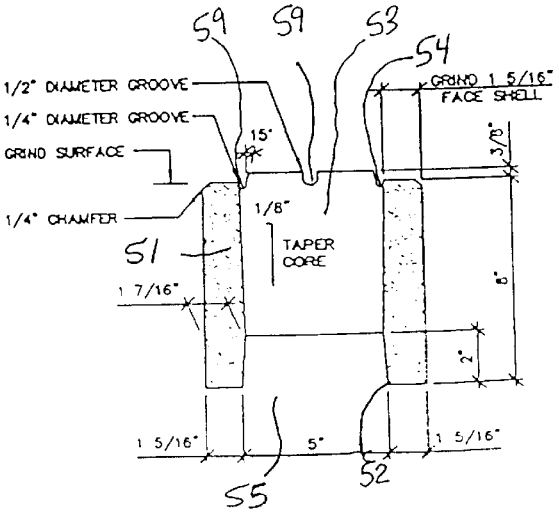

This problem is addressed in part by the block configuration depicted in FIG. 15, and further defined in FIGS. 17(*a*)–17(*c*). One advantage of this design of block is a space 55 left beneath webbing 53. This arrangement allows an installer or other mason to easily grab the block 50 at the bottom well above the bottom of flanges 51, which contact the top of the existing course of the blocks. The same type of block manipulation is not done nearly as easily using the block configuration of FIGS. 14(*a*)–14(*c*). As depicted in FIG. 17(*c*), this space 55 is approximately two inches in height, easy enough to be handled conveniently by an installer placing the block on an existing row of blocks. It should also be noted that this two inch space 55, which is only representative of the size of its space that can be used, can also be used as a ready-made conduit area. Thus, space 55 eliminates the necessity of the drilling holes through interior web 53 of block 50. As a result, installation of the blocks in a complex wall system becomes much easier. Further, masonry walls made from this kind of block are easier to incorporate in complex buildings.

While the aforementioned block configuration aids in the installation and handling of the block, it does not of itself eliminate the awkward necessity of threading block over a standing tendon using a small aperture in the block, as is required in the previous embodiments (FIGS. 1–13) of the first invention. This difficulty is addressed by the main or stretcher blocks of FIGS. 17(*a*)–17(*c*) and the corner block of FIGS. 18(*a*)–18(*c*). Instead of an aperture as depicted in FIGS. 1–13 of the present application, a slot 56 is provided. Slot 56, as with the aperture of FIGS. 1–13, is sized in relationship to the size of the tendon to be held therein, and the amount of maximum movement that is to be allowed before the blocks lock up with the tendon. As one example, for a standard CMU block, the slot can be 1¾ inch by 1¼ inch.

The size of the slot 56 will also be adjusted based upon the tightness of the nut 81 on the tendon 70 applying vertical force to the wall, and thereby further limiting the horizontal movement of the blocks 50 in the wall. As with standard blocks there are spaces 57 between the internal webbing 53. The webbing is tapered internally from top to bottom. This facilitates the insertion of foam cores into the spaces. The taper helps hold the foam cores more firmly and avoids the tendency for the cores to drop entirely through the spaces 57. The spaces 57 are generally 5 inches by 3¾ inches. However, different dimensions can be used even within the norm of a standard CMU-sized block.

Horizontal interlocking between horizontally adjacent blocks 50 is facilitated through the use of web extension 58, which is located at the end of the block 50 opposite slot 56. Structure 58 is an extension of interior web 53, extending approximately ¾ of an inch beyond flanges 51. A 15° bevel is applied to both sides of web extension 58 in order to more easily interface with the extending flanges 13 of the horizontally adjacent block 50. The bevel permits a certain amount of movement of horizontally adjacent blocks with respect to each other, as is consistent with the concept of the basic invention which relies upon the tendons 70 as the ultimate locking device when blocks are subjected to forces that cause horizontal movement. Yet, even within these constraints, the horizontal interlocking provided by fitting of extension 58 into flanges 51 of a horizontally adjacent block is an extremely desirable feature since the horizontal interlocking mechanism is relatively easy to manufacture and use in assembly of walls constituted by main blocks 50.

Figure 22A:
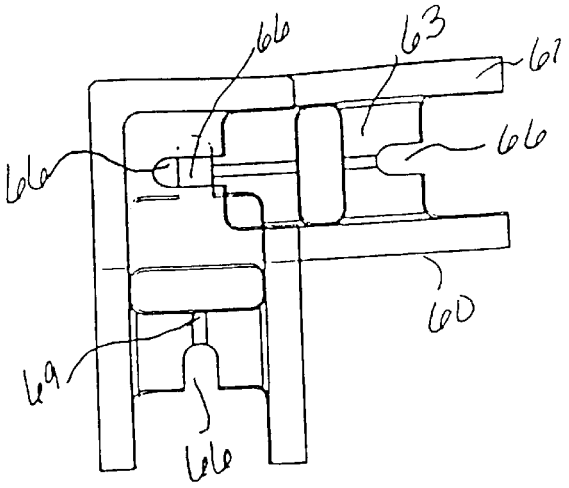
FIG. 22(*a*) is a top view of the block configuration of FIG. 21(*a*).
Figure 22B:
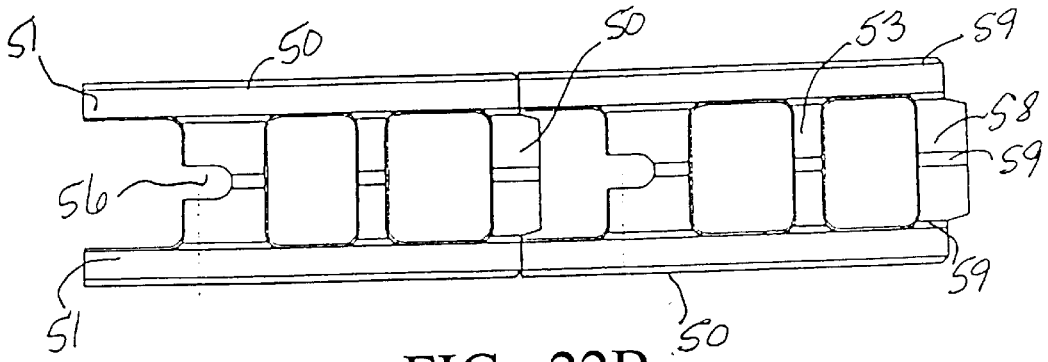
Figure 22C:
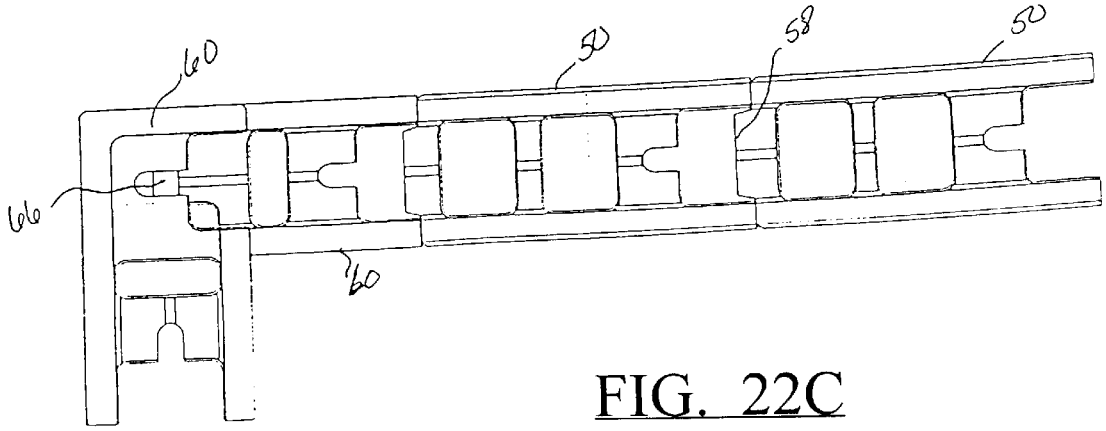
Figure 23C:
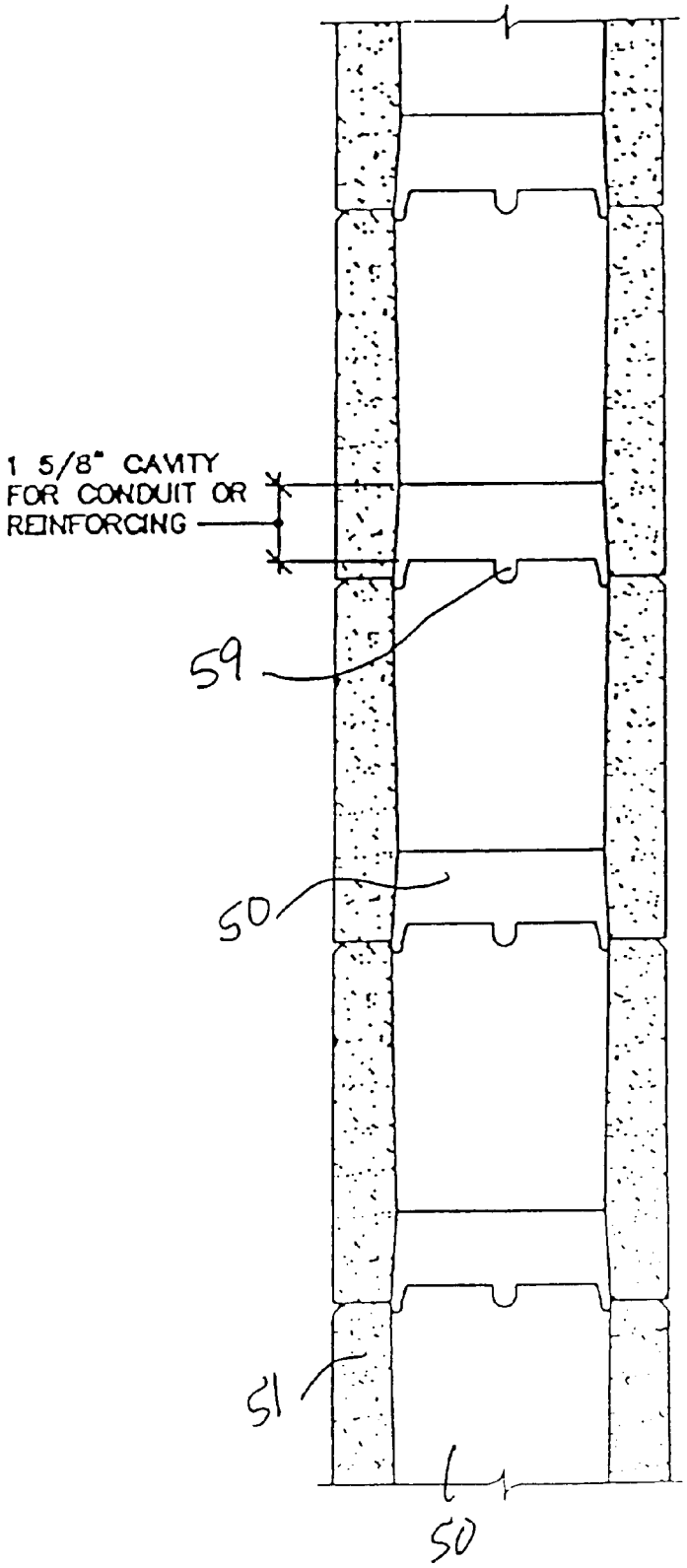
FIG. 23(*a*) is a perspective view of the block arrangement of FIG. 22(*c*).

The perspective views of FIGS. 19(*a*)–19(*d*) provide a better idea of how the main block 50 would fit together horizontally along the same course of blocks. For ease of handling, the block is usually grasped from the bottom at one of the web pieces 53. When the wall is assembled, the tendons are placed upright through the blocks of the wall. Accordingly, when a block is placed on an existing row of blocks, the block is manipulated so that the open end of the slot 56 is moved to the tendon. The use of the open end of the slot 56 removes the necessity of fitting the entire block over the tendon 70 rather than simply sliding the block against the tendon. An example two blocks fit together horizontally is depicted in FIG. 22(*b*). A multiple course of blocks is depicted by the top view of FIG. 22(*c*). A sectional end view of a stack of blocks 50 is depicted in FIG. 23(*c*).

An additional structure is depicted in FIG. 17(*c*). There are three groves or troughs 59 formed in the upper surface of both flanges 51 and interior web sections 53. The troughs are best depicted as shown in FIG. 17(*c*), and are arranged in the middle of the web structure 53 and at the surface 54 where the web structure interfaces with the flanges. These troughs allow water that has entered the interior of the wall to drain downwards through the wall spaces 57 as quickly as possible. Once the water has reached the bottom of the wall, conventional drainage techniques can be used to carry it away from the wall. Because the conventional techniques are already well-known to those skilled in this art, further elaboration upon them is not necessary. The key attribute of this embodiment of the present invention is the use and placement of troughs at the top of each of the blocks. The troughs 59 can be formed in the blocks during manufacturing by conventional molding processes, or the troughs can be cut or ground into the blocks before installation.

Figure 18A:
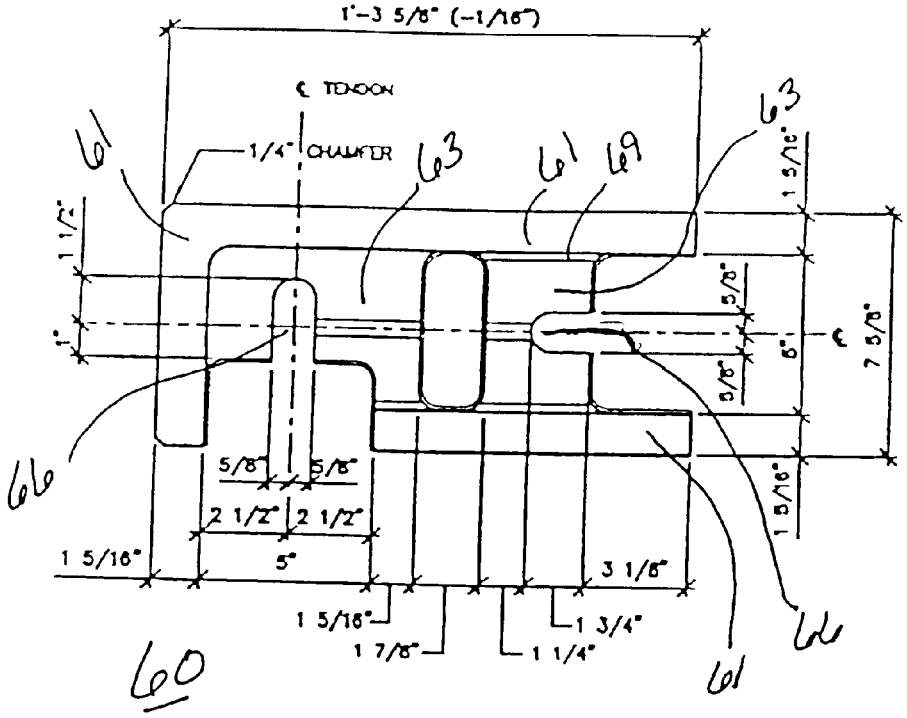
FIG. 18(*a*) is a top view of a corner block used in conjunction with the block of FIGS. 17(*a*)–17(*c*).
Figure 18B:
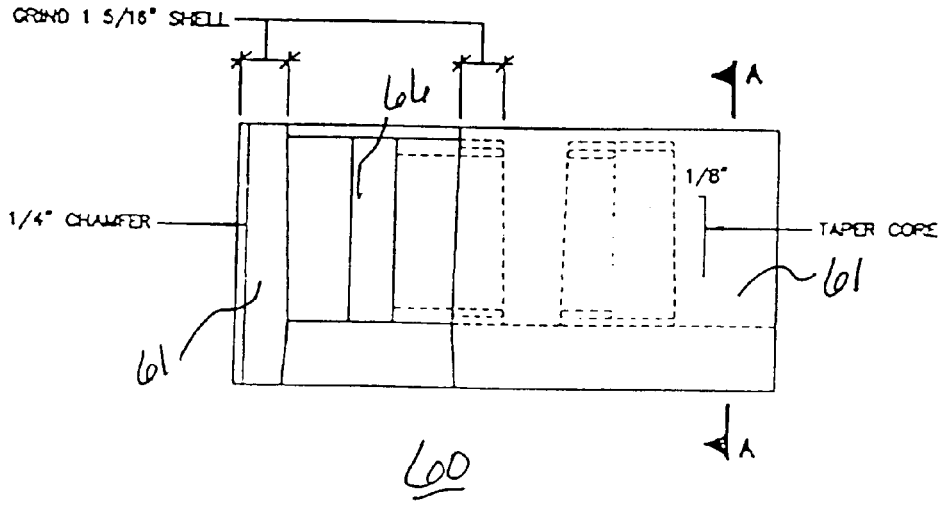
Figure 18C:
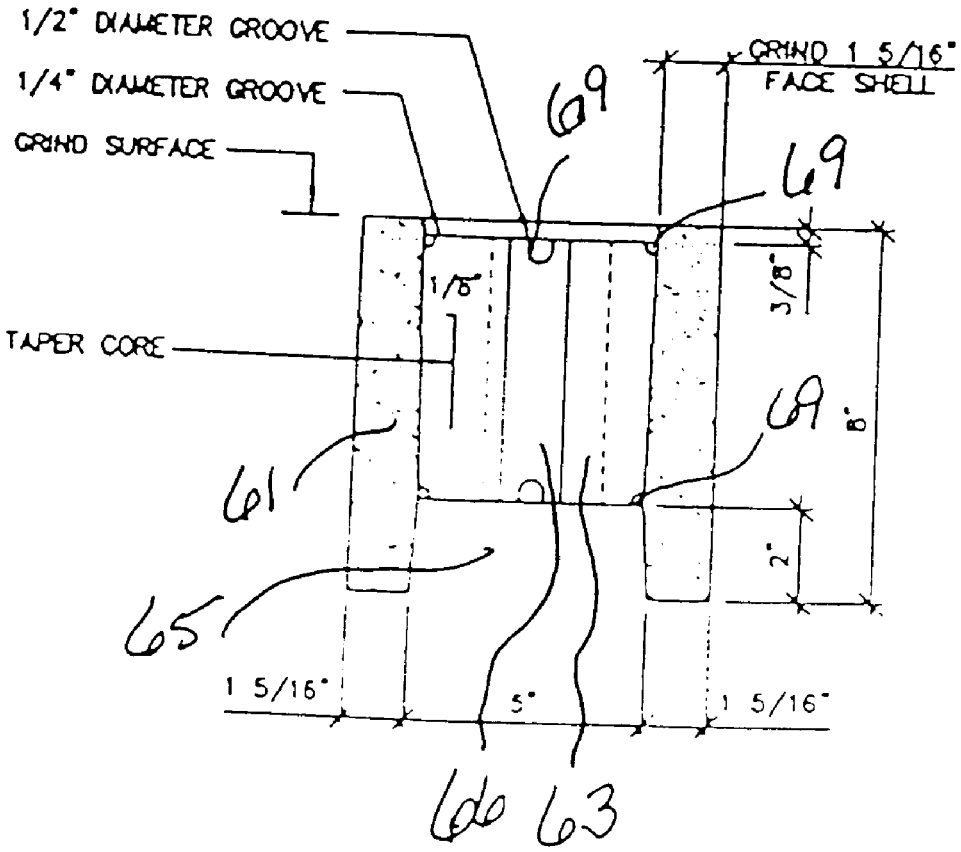
Figure 21A:
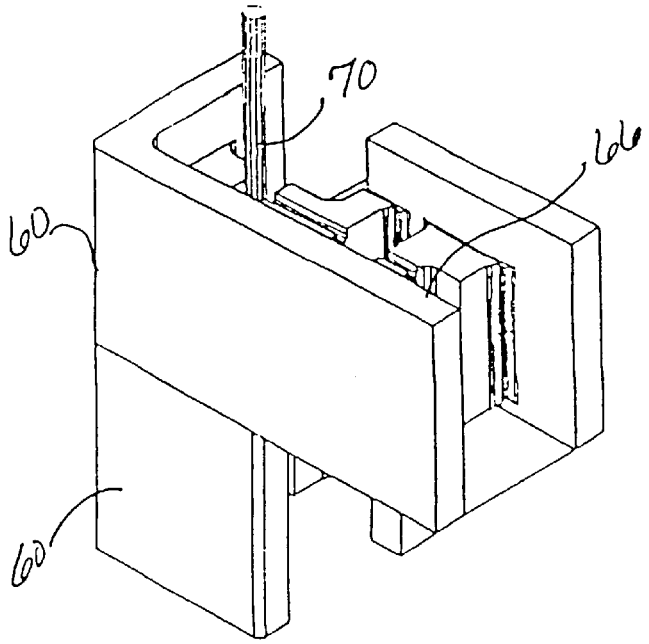
FIG. 21(*a*) is a perspective view depicting an inventive configuration of alternating corner blocks.
Figure 21B:
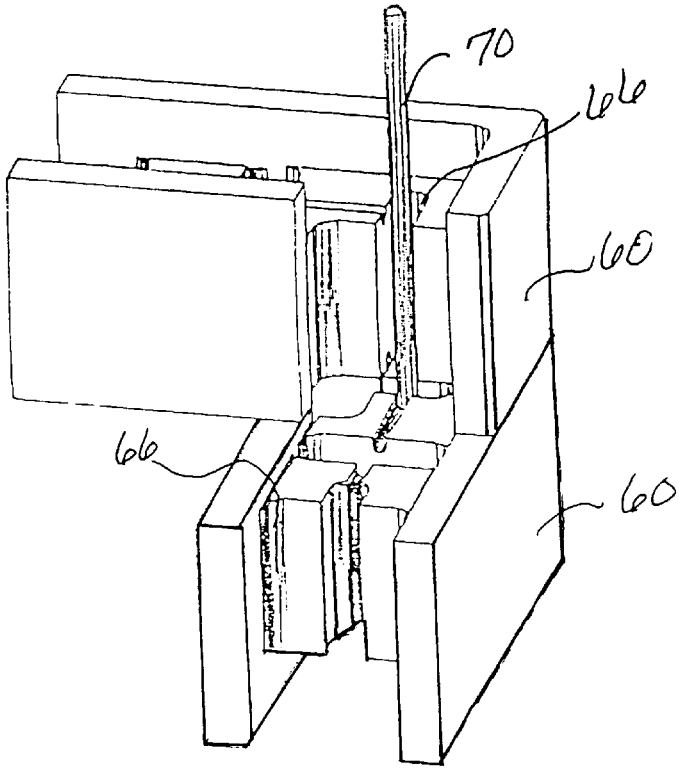
Figure 21C:
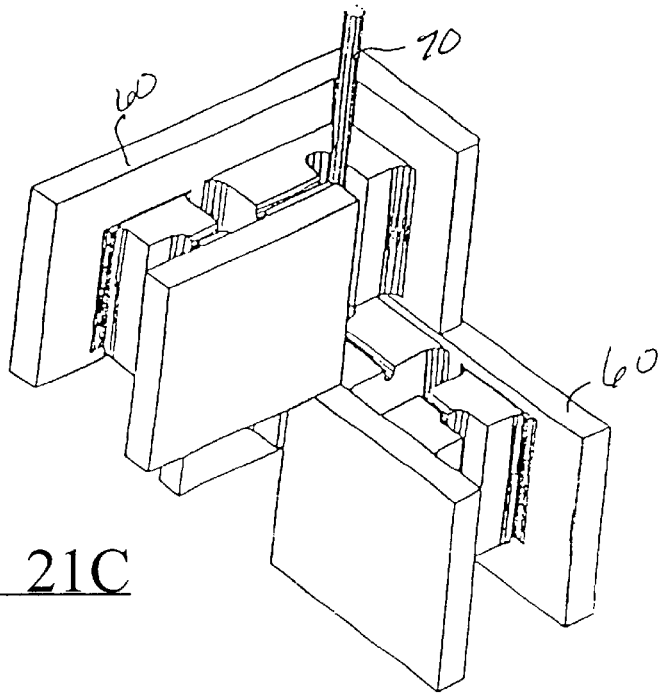
Figure 21D:
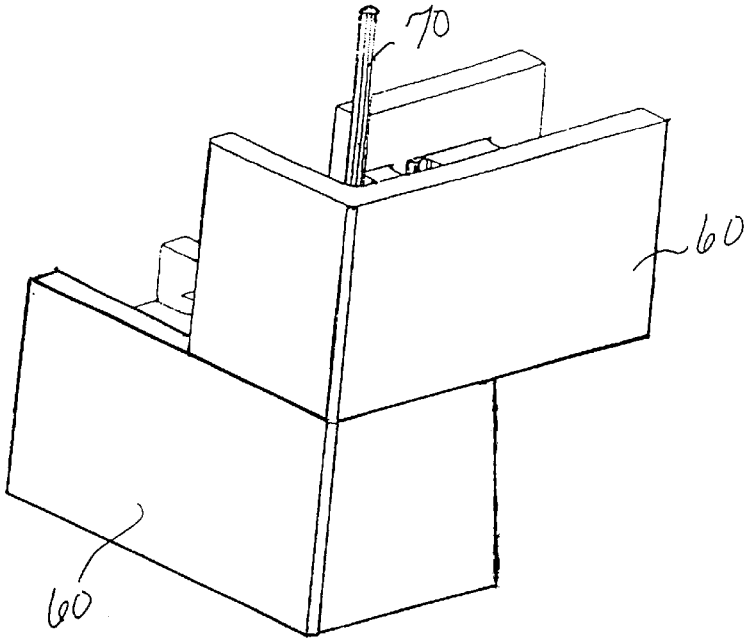

Drainage troughs are also found on corner blocks, such as those depicted in FIGS. 18(*a*)–18(*c*). Each corner block has two slots 66 on opposite ends of the block 60. Like the main block 50, the corner blocks have interior webbing 63 with spaces therebetween. Troughs 69 are formed in the interior webbing in the same manner as is done is done for the main blocks 50. The general size of the corner blocks is comparable to that of the main blocks. Like the main blocks, the webbing 63 of the corner blocks is tapered downward to help hold core insulating material in the spaces between the webbing. The corner block 60 also has a conduit space 65 of approximately two inches in height in order to permit easy handling of the block, and the provision of conduits in the same manner as is done for the main blocks 50.

Unlike main blocks 50, the webbing 63 of corner block 60 remains below the flanges 61 by approximately ⅜ of an inch for a typical block of CMU standard size. Like the main blocks 50, the vertical edges of the flanges of the corner blocks are beveled or chamfered for ease of handling. FIGS. 20(*a*)–20(*d*) depict various respective views of one orientation of corner block 60. It should be noted that there are always two slots 66 for each corner block and that these have opened ends facing 90° with respect to each other.

FIGS. 21(*a*)–21(*d*) depict perspective views of two rows of corner blocks 60 stacked on each other. As is clear from the subject drawings, the lower block has its own longer portion arranged 90° to the longer portion of the upper corner block. However, both blocks can be exactly the same. The change in orientation is effected simply by turning over one of the blocks. It should be noted that if this is done slight modifications from the corner block of FIGS. 18(*a*)–18(*c*) can be made to facilitate this arrangement. In particular, the flanges 61 can be arranged to extend approximately an inch to two inches above interwebbing 63 at both the top and the bottom of the block. It should be noted that troughs 69 are arranged on both the upper and lower surfaces of interior webbing 63 so that when corner blocks 60 is turned over to change its orientation for alternating courses of block, the beneficial effects of the troughs are still retained. Even if no other modifications are made to the corner block 60, it can be used in this manner.

In the alternative, a second type of corner block with an opposite orientation can be manufactured and used for alternating the orientation from one course of blocks to the next. While this arrangement may result in easier handling of blocks unmodified from those of FIGS. 18(*a*)–18(*c*), this is not the preferred arrangement. The use of a corner block having an alternating orientation requires that a third block be manufactured for the inventive wall system, rather than only the two depicted in FIGS. 17(*a*)–17(*c*) and 18(*a*)–18(*c*). Any necessity to make additional types of blocks raises the overall cost of the wall system, and so, is to be avoided. Thus, one of the major advantages of this aspect of the present invention is that an entire wall system can be constructed using only two types of blocks.

One advantage of the alternating orientations of the corner blocks is that the slots through which tendons 70 pass are changed in orientation. Thus, one slot will have its open end 90° from the open end of the slot of the next course of blocks. This helps create a substitute for the enclosed aperture used to hold the tendon in the previous embodiments of FIGS. 1–13 of the present application. Further, tendons need not be put under pressure for the corner blocks. Rather, they may simply be placed loosely in the stacked slots, serving as rebar in the traditional sense of this structure. In a minor alternative, the tendon, serving as conventional rebar can simply be held at the base of the wall by grout or other conventional methods. The use of tendons 70 under tension as provided by the tightening of a spring-loaded nut on a lintel is applied to selected points along the main block 50 constituting the majority of the wall. This arrangement is also depicted in FIG. 22(*a*) and FIG. 22(*c*).

The tensioned tendons 70 are arranged through slots 56 of main blocks 50 in order to provide the benefits of adjustable wall flexibility. The effects of a solid, entirely enclosed aperture is achieve by alternating the orientation of main blocks 50 from course to course. The result of this arrangement is depicted in FIGS. 23(*a*) and 23(*b*). The alternating slot orientations of alternating rows of blocks create the effect of an enclosed aperture which tendons 70 are arranged.

The result is also an alternating seamline so that the only complete seams running from the top to the bottom of the wall are found at the corners. This is crucial to the integrity of the wall since a straight seamline between blocks along the vertical height of the wall leads to a number of drawbacks for such a wall system. As depicted in FIGS. 23(*a*) and 23(*b*), the tendon going through each of the corner blocks for a particular corner can be placed loosely, and can be constituted by an epoxy bar, operating in a conventional rebar role.

The main blocks 50 appear to each contain one tendon 70, which will be put under tension to achieve the benefits of the present invention. However, the placement of the tendons 70, as shown in FIGS. 23(*a*) and 23(*b*), is not necessary for the operation of the present invention. Rather, any arrangement for spacing of the tendons can be used, consistent with the concept of the present invention. Such spacing is usually determined by the kind of forces (such as seismic effects) that will be placed upon a particular wall system. The placement and spacing of the tendons will also, to some extent, determine the level of tension to be placed upon each of the tendons. These factors can also be altered based upon the height of the wall, as well the types of loads to be placed on the wall system.

Figure 24A:
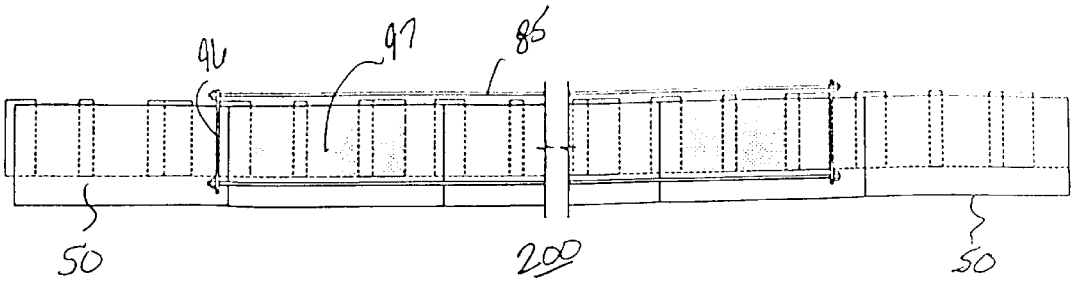
FIG. 24(*a*) is a side view depicting the horizontally tensioned structure of masonry blocks, such as a lintel structure.
Figure 24B:
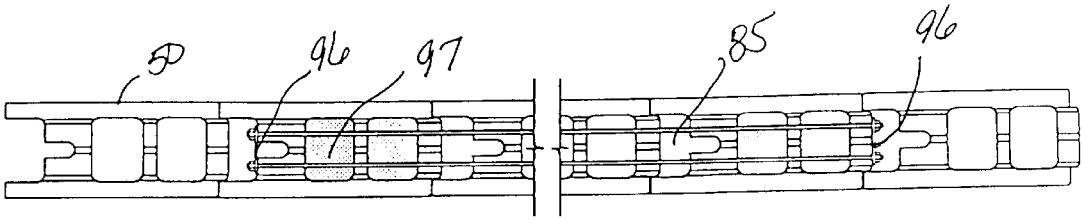
Figure 24C:
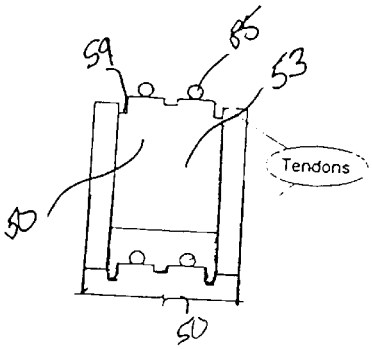
Figure 26:
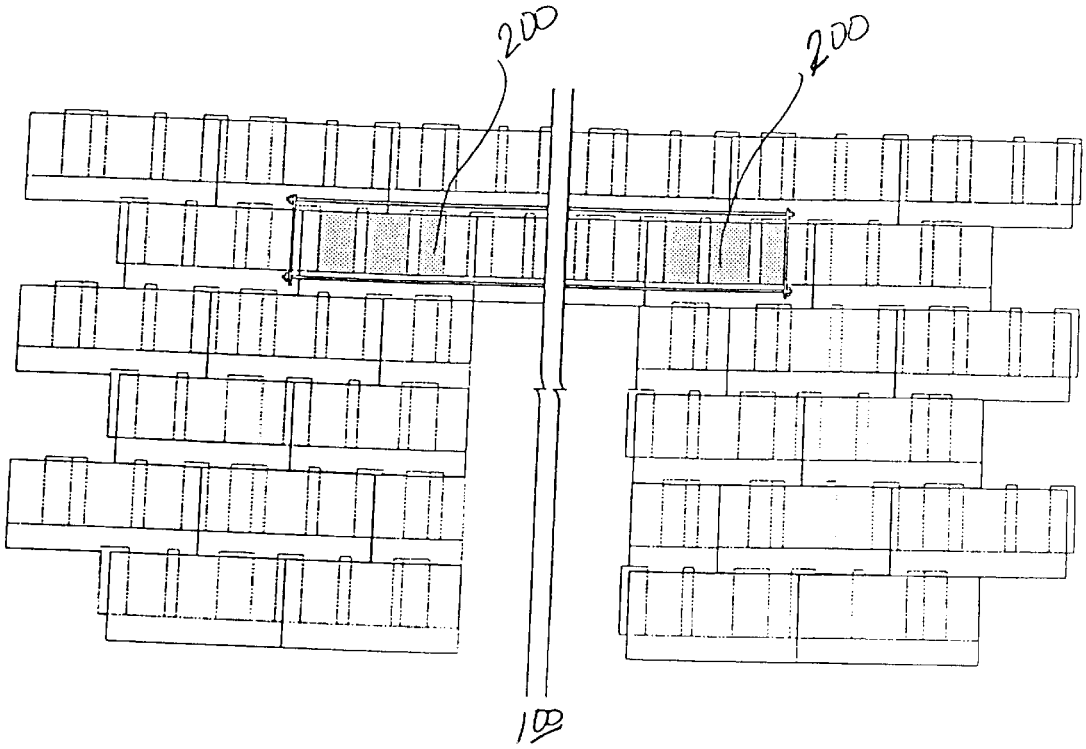
FIG. 26 is a front view of a wall arrangement containing the structure of FIGS. 24(*a*)–24(*c*).

Vertical tensioning of support tendons is only one aspect of the present invention. The tensioning of horizontal supports or tendons can also be carried out as another embodiment of the present invention. FIGS. 24(*a*)–24(*c*) depict a horizontal support arrangement using tendons 85 under tension using side plates 96. This technique can be used to create stable horizontal structures of masonry block to serve as lintels, for example. An arrangement of such a lintel 200 is depicted in FIG. 26. The lintel supports the wall blocks 50 above an opening in wall section 100. Such a structure is created by placing tendons 85 as depicted in FIG. 24(*c*). Preferably, the tendons are arranged atop the central webbing 53 of block 50 in a manner that avoids blocking any of the water troughs 59.

Figure 25A:
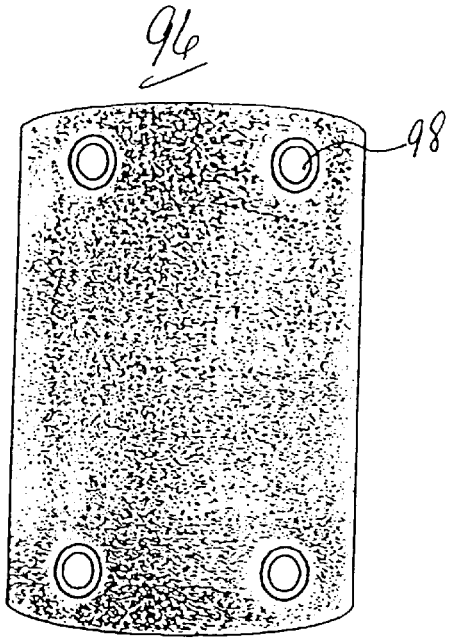
FIGS. 25(*a*)–25(*c*) depict the end piece hardware and its mounting for the arrangement of FIGS. 24(*a*)–24(*c*).
Figure 25B:
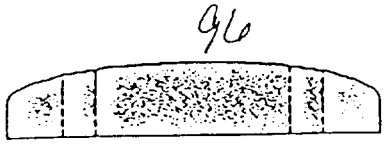
Figure 25C:
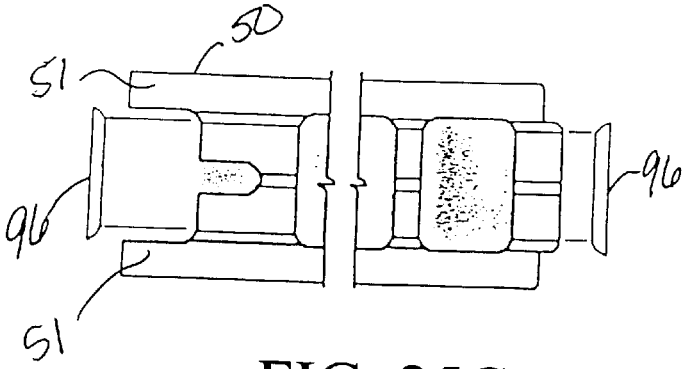

Structure 200 is provided with end hardware as depicted in FIGS. 25(*a*)–25(*c*). The hardware is relatively simple, consisting of end plates 96, which are curved in order to better interface with the ends of block 50. This is especially important for the plate 96 which will fit between flanges 51. In the depicted embodiment, each of the end plates 96 is formed with four holes 98 for tendons 85. Preferably, the tendons are formed to have threaded portions at each end in order to accommodate bolts for tightening the tendons to provide horizontal tension which is applied as horizontal pressure to the lintel structure 200.

Figure 27:
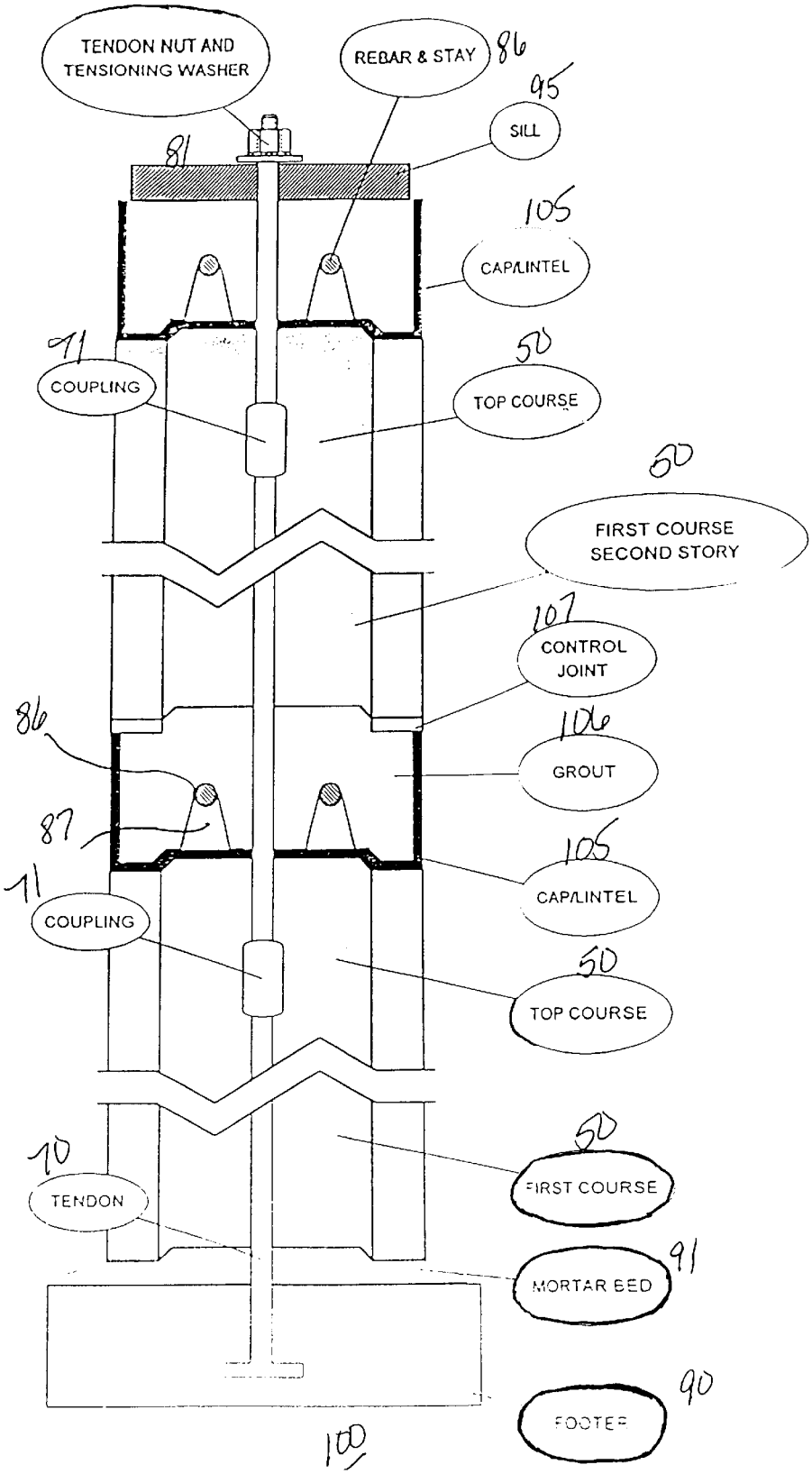
FIG. 27 is a sectional side view depicting a wall system vertically sectionalized to separate the vertical sections, such different stories, from each other, and to provide additional reenforcement.

The post tensioning aspects of the present invention can be arranged on wall systems constituting multi-story buildings. The overall tendons can be made as long as necessary through the use of couplings 71, which are applied to the threaded ends of the tendon 71. The tendon 71 can be screwed into a pressure plate, or in the alternative, fixed in a footer 90 or a mortar bed 91 on the footer. As depicted in FIG. 27 the wall is vertically sectionalized using a cap/lintel made of metal. Reenforcing bar or rebar runs horizontal along the course of the wall, and is fixed to the lintel 105 with stays 87. The cap or lintel is filled with grout or mortar to fix the rebar in position. Additional courses of block are placed on the mortar-filled cap through control joints 107. At each story of the building, a cap/lintel 105 is placed atop the courses of block in order to provide better horizontal reenforcement. At the top of the last story of blocks, a sill 95 is used to support the tendon nut 80 as previously described with respect to FIG. 15. The horizontal rebar 86 can be constituted by threading tendons such as 70. These can be put under tension in the same manner described with respect to FIGS. 24(*a*)–24(*c*).

For all of the embodiments of FIGS. 24(*a*)–24(*c*), 25(*a*)–25(*c*) and 27, additional support for the horizontally tensioned structure is often needed. This can be provided by filling selected spaces between interior webs 53 of the blocks with mortar or grout to form a solid structure. This is represented by filled space 97 in both FIGS. 24(*a*) and 24(*b*). The solid fill 97 for certain blocks 50 prevent the blocks from collapsing under high tension created by tendons 85.

The tensioning of tendons (both horizontal and vertical) creates a much stronger, resilient masonry structure. However, the integrity of the masonry system can be undermined by misalignment, leading to uneven loading and the degradation of individual blocks. This can be exacerbated by the forces caused by tensioning tendons 70 and 85. A major problem can be misalignment of the lower course of blocks on mortar bed 91 and footer 90. When maximum pressures are developed using a tendon 70, a bearing plate 92 is usually involved so that the footer is not degraded by the tension on the tendon. It has been discovered that alignment between bearing plate 92 and the bottom block 50 on that bearing plate can be crucial when large forces are developed in the tightening of the nut 81 (FIG. 16) which forces sill 95 against the top course of the block.

Figure 28A:
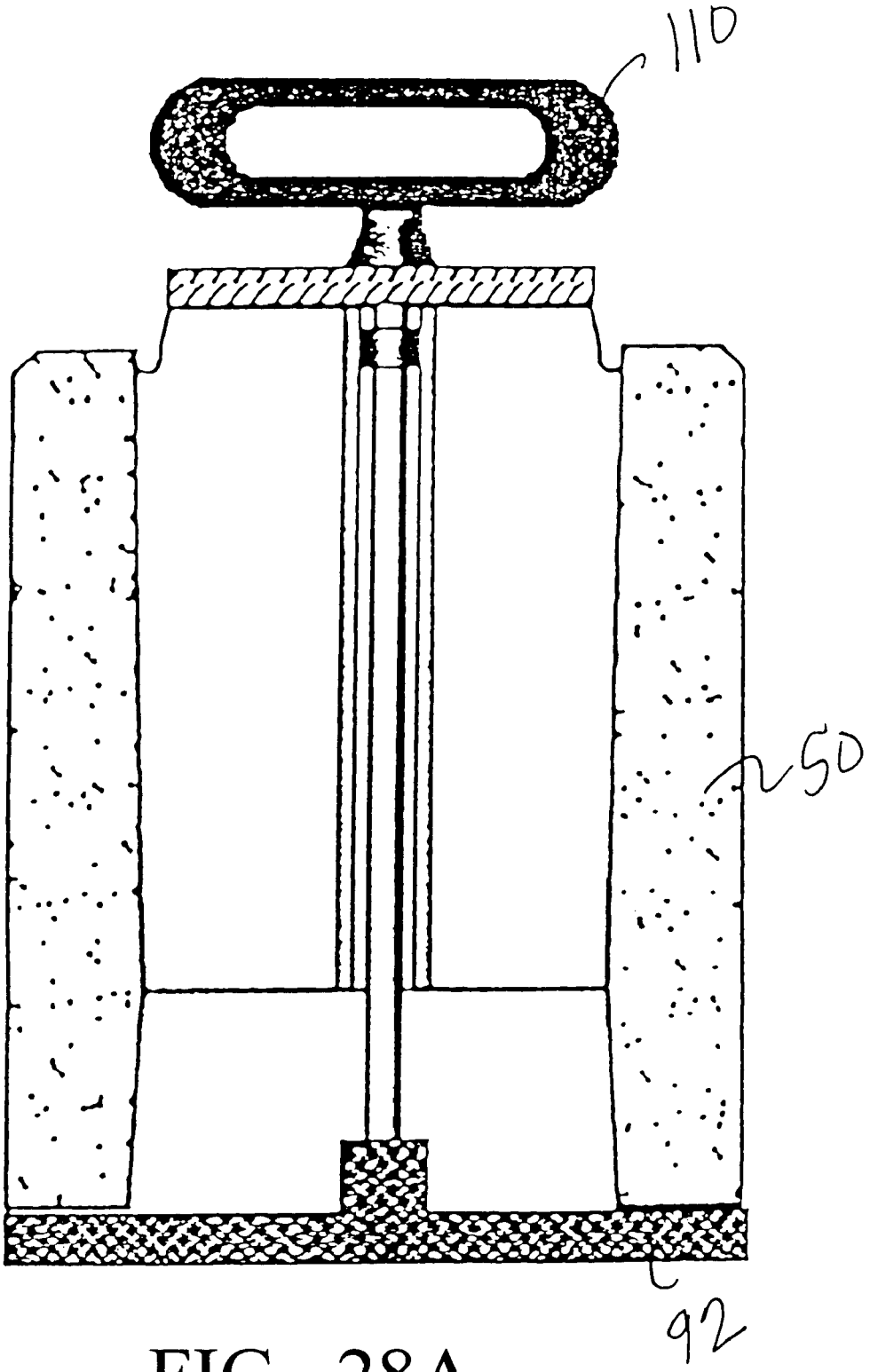
FIG. 28(*a*) is a side sectional view depicting the relationship between an aligning tool, a bearing plate, and a block to be mounted on the bearing plate.
Figure 28B:
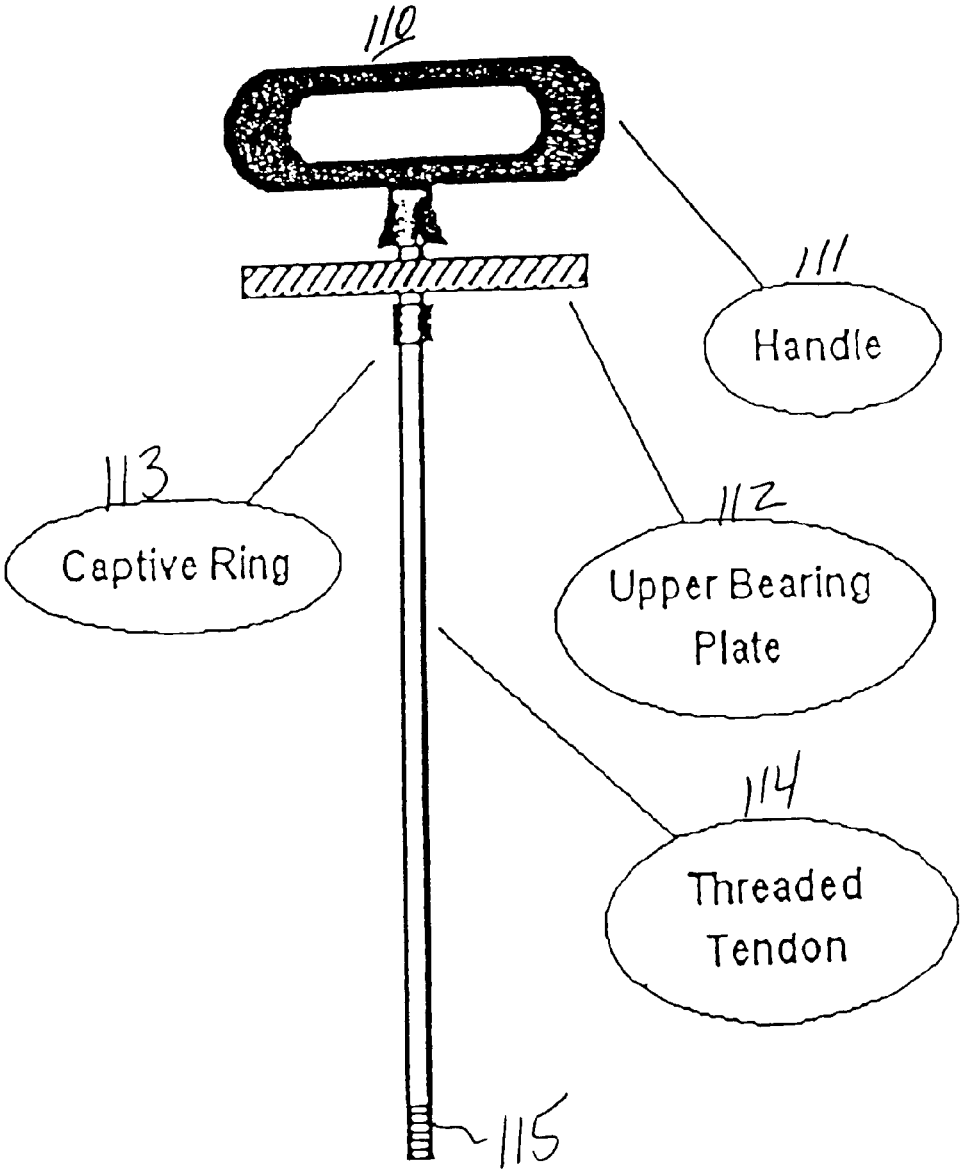
Figure 28B:
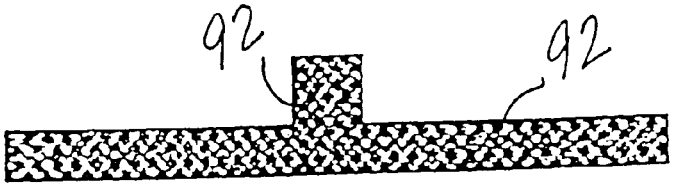

In order to properly align the lower course of block 50 on bearing plate 92, an alignment tool 110 (as depicted in FIGS. 28(*a*) and 28(*b*)) is used. The alignment tool 110 has a handle 111, and upper bearing plate 112 and a captive ring 113. Extending from the upper bearing plate 112 is a threaded tendon 114 ending in a threaded portion 115. This threaded portion is screwed into a threaded receptricle 93 on bearing plate 92. The lower course of blocks 50 is held as depicted in FIG. 28(*a*). Once proper alignment of the block, bearing plate and footer are achieved, mortar is used to hold the bearing plate and the lower course of block in place. Tool 110 is removed as soon as the grout or mortar is dried to hold the bearing plate and lower blocks 50. Once tool 110 is removed, a standard tendon 70 can be inserted. Since the bearing plate 92 has been properly aligned with the lower course of blocks, the tendon can be placed and subsequent rows of blocks arranged around it without the problems caused by misalignment.

It is crucial that the bottom course of blocks 50 be firmly attached to the footer 90 and mortar bed 91 which is used to hold the block. Not every block along the bottom course has its own bearing plate 92 and tendon 70. However, additional holding capability, beyond that provided by mortar, is often necessary. One technique has been the use of off-set masonry spikes 120, such as that depicted in FIG. 29(*b*). The masonry spike is driven into the footer where it is held into place through the aid of its off-set construction. The top of the spike above the footer extends into the lowest block. Conventionally, mortar is used to fill in the space around the off-set masonry spike within the bottom block 50. Typically, the masonry spike is driven through an aperture in the block. This is done with a hammer. Unfortunately, in conventional usage, the hammer is often brought too close to the block so as to knock it out of alignment or damage the block. An additional problem exists in that there is no accurate way of determining the precise depth of the spike as it is being driven in. Since the use of spikes can be crucial of wall systems under a great deal of stress, the accurate use of masonry spikes in those blocks or tendons are not used can be very important.

Figure 30B:
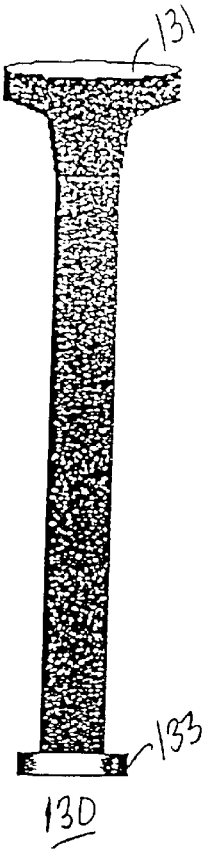
FIG. 30(*a*) is a side sectional view depicting the arrangement of a tool for aligning a reenforcing rod within a block/footer arrangement.
Figure 30A:
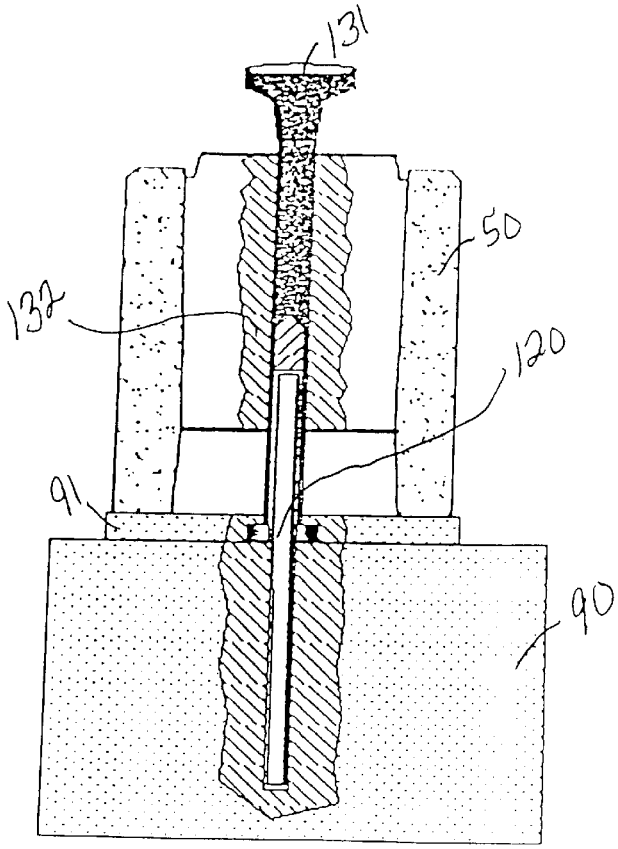

This problem is addressed by driving tool 130 in FIG. 30(*b*). This tool has an upper surface 131 for receiving blows from the hammer, and a hollowed-out portion 132 for receiving a masonry spike. The end of the hollowed-out portion interfaces with the top of the masonry spike 120 and transfers the hammer blows against surface 131 to the masonry spike to drive the spike into the footer 90. The bottom flange 133 comes to rest on the footer once the spike has been driven into its proper depth. The tool 130 is then removed from the block, and the space around the masonry spike above the footer is filled in with grout or mortar.

Although the above description contains many specific details, these should not be construed as limiting the scope of the present invention but as merely providing illustrations of some of the presently preferred embodiments of the invention. Accordingly, the present invention should be considered to include any and all variations, permutations, modifications and adaptations that would occur to any skilled practitioner that has been taught to practice the present invention. For example, it is envisioned that other components using the same features may be added later such as: partition blocks, end caps and lintels. Thus, the scope of the invention should be limited only by the appended claims and their legal equivalents, rather than the examples given herein.

I claim:

1. A flexible interlocking wall system including a plurality of blocks having means for interlocking without mortar between vertically adjacent blocks, said wall system having at least two major surfaces, each major surface forming a wall face, said wall system comprising:

(a) a plurality of main blocks, each main block having at least one stabilizing slot, said stabilizing slot positioned to be at least partially vertically collinear with stabilizing slots in vertically adjacent main blocks when positioned with respect to each other in an interlocking configuration to form a wall face; and, (b) a plurality of reinforcing tendons placed in selected stabilization slots through a plurality of said main blocks, each aid reinforcing tendon being sized and spring-tensioned with respect to said slot to permit predetermined movement and return of said blocks in at least one horizontal direction for a predetermined extent to relieve stress on said wall system, each said reinforcing tendon being connected at both upper and lower ends of said wall system.

2. The flexible interlocking wall system of claim 1, wherein all said blocks comprise horizontal interlocking means for connecting horizontally adjacent blocks to each other.

3. The flexible interlocking wall system of claim 1, wherein at least some of said blocks comprise vertical interlocking means for connecting vertically adjacent blocks to each other.

4. The flexible interlocking wall system of claim 1 wherein said blocks are of masonry, and connected to each other without mortar at interfaces between said blocks.

5. The flexible interlocking wall system of claim 1, wherein said blocks comprise main blocks, and corner blocks extending in two substantially perpendicular directions.

6. The flexible interlocking wall system of claim 4, wherein said wall system is mounted on a foundation, and connected thereto using mortar.

7. The flexible interlocking wall system of claim 6, further comprising a template mounted on said foundation and arranged to interlock with said blocks vertically adjacent to said foundation.

8. The flexible interlocking wall system of claim 7, further comprising a cap piece located on top of said wall system, extending along a length of said wall, and arranged for connecting to said reinforcing tendons.

9. A flexible interlocking wall system comprising:

(a) a plurality of blocks; and, (b) spring-loaded means for transferring stress vertically from block to block, permitting horizontal movement of said blocks and locking adjacent vertical blocks at a predetermined extent of said horizontal movement, said means for transferring stress extending vertically through said entire wall system.

10. The flexible interlocking wall system of claim 9, wherein said means for transferring stress comprise elongated reinforcing tendons placed in a plurality of aligned vertical openings in said blocks.

11. The flexible interlocking wall system of claim 10, wherein said predetermined extent of movement is determined by spacing between said aligned vertical openings and said elongated reinforcing tendons.

12. The flexible interlocking wall system of claim 11 wherein said wall system comprises a bottom tier of blocks arranged on an external foundation, and held in place through the use of mortar between said bottom tier blocks and said external foundation.

13. The flexible interlocking wall system of claim 12, wherein each said block further comprises horizontal interlocking means for connecting to horizontally adjacent blocks.

14. The flexible interlocking wall system of claim 13, wherein at least some of said blocks further comprise vertical interlocking means for connecting to vertically adjacent blocks.

15. The flexible interlocking wall system of claim 14, wherein said elongated reinforcing tendons comprise steel rods connected to said external foundation.

16. The flexible interlocking wall system of claim 15, wherein said blocks are masonry, and are connected to each other without mortar.

17. A flexible interlocking wall system comprising:

(a) a plurality of blocks; and, (b) means for transferring stress vertically from block to block, permitting horizontal movement of said blocks and locking adjacent vertical blocks at a predetermined extent of said horizontal movement, said means for transferring stress comprising vertical interlocking means for connecting to vertically adjacent blocks, said vertical interlocking means comprising ground finished bearing surfaces.

18. The flexible interlocking wall system of claim 17, wherein said means for transferring stress further comprise complementary horizontal bearing surfaces on said blocks.

19. The flexible interlocking wall system of claim 18, wherein said predetermined extent of said horizontal movement is determined by an extent of interface between said complementary horizontal bearing surfaces, and tolerances between adjacent vertical interlocking means.

20. The flexible interlocking wall system of claim 19, wherein said each said block comprises a core structure protruding upwards and a pair of sidewalls arranged on either side of said core structure and protruding downwards.

21. The flexible interlocking wall system of claim 20, wherein said complementary horizontal bearing surfaces are constituted by top and bottom surfaces of said pair of sidewalls.

22. The flexible interlocking wall system of claim 21, wherein said vertical interlocking means further comprise complementary beveled mating surfaces on said center structure and said pair of sidewalls.

23. The flexible interlocking wall system of claim 22, wherein said blocks are masonry, and are connected to each other without mortar.

24. The flexible interlocking wall system of claim 23, wherein said complementary horizontal bearing surfaces and said complementary beveled mating surfaces are precision-ground to achieve maximum contact between said complementary beveled mating surfaces and said complementary horizontal bearing surfaces.

25. The flexible interlocking wall system of claim 24, wherein said means for transferring stress further comprise a plurality of at least one steel rod placed in at least one series of aligned vertical openings in said blocks.

26. The flexible interlocking wall system of claim 25, wherein said complementary beveled mating surfaces are formed at an angle of approximately 75° from horizontal.

27. The flexible interlocking wall system of claim 25, wherein each block further comprises horizontal interlocking means for connecting to horizontally adjacent blocks.

28. The flexible interlocking wall system of claim 27, wherein at least of some said blocks comprise vertical interlocking means.

29. The flexible interlocking wall system of claim 28, wherein said at least one steel rod is connected to an external foundation.

30. A flexible interlocking wall system comprising:

(a) a plurality of blocks formed into successive tiers and supported by an external foundation;

(b) means for transferring stress from block to block through an entirety of said tiers of said block system, said means for transferring stress being attached at one end at said foundation and at another end at a top of said wall system; and, (c) spring-loaded tension means for controlling vertical force on said wall system through said means for transferring stress.

31. The flexible interlocking wall system of claim 30, wherein said spring-loaded tension means are adjustable.

32. The flexible interlocking wall system of claim 31, wherein said foundation comprises a concrete footer.

33. The flexible interlocking wall system of claim 32, wherein adjustment of said spring-load tension means determines an amount of force on said wall system necessary to cause a predetermined extent of horizontal movement of said blocks.

34. The flexible interlocking wall system of claim 33, wherein said spring-loaded tension means comprise a top plate arranged on top of said blocks of a top tier of said wall system, vertical force on said wall system being exerted through said top plate.

35. The flexible interlocking wall system of claim 34, wherein said spring-loaded tension means further comprise a spring resting on said top plate and connected to an elongated reinforcing tendon extending through said wall system to said footer.

36. The flexible interlocking wall system of claim 35, wherein said spring-loaded tension means further comprises a connector on top of said spring and attached to a threaded portion of said elongated reinforcing tendon.

37. The flexible interlocking wall system of claim 36, further comprising a bearing plate attached to said footer and underlying a full thickness of at least one of said blocks, said elongated reinforcing tendon being attached to said bearing plate.

38. The flexible interlocking wall system of claim 37, wherein said elongated reinforcing tendon comprises at least one steel rod having a threaded portion attached to a threaded receptacle on said bearing plate.

39. The flexible interlocking wall system of claim 38, wherein said elongated reinforcing tendon comprises a plurality of steel rods, linearly connected together using couplings.

40. The flexible interlocking wall system of claim 39, wherein said bearing plate is attached to said footer using a bed of mortar.

41. The flexible interlocking wall system of claim 40, wherein said blocks are masonry, and are connected to each other without use of mortar.

42. The flexible interlocking wall system of claim 41, wherein each said block comprises a core structure enclosed on two sides by sidewalls, and said means for transferring stress further comprise ground horizontal bearing surfaces on said sidewalls of each said block.

43. The flexible interlocking wall system of claim 42, further comprising a conduit space extending for a length of said wall system for each said tier, said conduit space being formed as a part of each said block when it is cast.

44. The flexible interlocking wall system of claim 43, wherein each said block further comprises a set of groves formed between said core structure and said sidewalls, said groves being configured to convey moisture horizontally along a top of each said block to vertical openings in said core structure of each said block.

45. The flexible interlocking wall system of claim 44, wherein said elongated reinforcing tendons extend through said tiers of said wall system via slots formed in said core structure of said blocks, said slots being oriented differently from tier to tier to effect an enclosed hole for each two tiers of said blocks.

* * * * *